US006588884B1

(12) United States Patent
Furlani et al.

(10) Patent No.: US 6,588,884 B1
(45) Date of Patent: Jul. 8, 2003

(54) TRI-LAYER THERMAL ACTUATOR AND METHOD OF OPERATING

(75) Inventors: Edward P. Furlani, Lancaster, NY (US); John A. Lebens, Rush, NY (US); David P. Trauernicht, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/071,120

(22) Filed: Feb. 8, 2002

(51) Int. Cl.[7] ..... B41J 2/04
(52) U.S. Cl. ..... 347/54
(58) Field of Search ..... 347/54, 68, 69, 347/70, 71, 72, 50, 40, 20, 44, 47, 27, 63; 399/261; 361/700; 310/328–330; 29/890.1

(56) References Cited

U.S. PATENT DOCUMENTS

| | | | |
|---|---|---|---|
| 3,747,120 | A | 7/1973 | Stemme |
| 3,946,398 | A | 3/1976 | Kyser et al. |
| 4,296,421 | A | 10/1981 | Hara et al. |
| 5,599,695 | A | 2/1997 | Pease et al. |
| 5,771,882 | A | 6/1998 | Psaros et al. |
| 5,902,648 | A | 5/1999 | Naka et al. |
| 6,067,797 | A | 5/2000 | Silverbrook |
| 6,234,609 | B1 | 5/2001 | Silverbrook |
| 6,239,821 | B1 | 5/2001 | Silverbrook |
| 6,243,113 | B1 | 6/2001 | Silverbrook |
| 6,254,793 | B1 | 7/2001 | Silverbrook |
| 6,274,056 | B1 | 8/2001 | Silverbrook |

FOREIGN PATENT DOCUMENTS

| | | |
|---|---|---|
| JP | 20330543 | 1/1990 |

*Primary Examiner*—Raquel Yvette Gordon
(74) *Attorney, Agent, or Firm*—William R. Zimmerli

(57) ABSTRACT

An apparatus for and method of operating a thermal actuator for a micromechanical device, especially a liquid drop emitter such as an ink jet printhead, is disclosed. The disclosed thermal actuator comprises a base element and a cantilevered element extending from the base element and normally residing at a first position before activation. The cantilevered element includes a barrier layer constructed of a low thermal conductivity material, bonded between a deflector layer and a restorer layer, both of which are constructed of materials having substantially equal coefficients of thermal expansion. The thermal actuator further comprises an apparatus adapted to apply a heat pulse directly to the deflector layer, causing a thermal expansion of the deflector layer relative to the restorer layer and deflection of the cantilevered element to a second position, followed by restoration of the cantilevered element to the first position as heat diffuses through the barrier layer to the restorer layer and the cantilevered element reaches a uniform temperature. When used as a thermal actuator for liquid drop emitters, the cantilevered element resides in a liquid-filled chamber that includes a nozzle for ejecting liquid. Application of a heat pulse to the cantilevered element causes deflection of a free end forcing liquid from the nozzle. The barrier layer exhibits a heat transfer time constant $\tau_B$. The thermal actuator is activated by a heat pulse of duration $\tau_P$ at a repetion time of at least $\tau_C$, wherein $\tau_P < \frac{1}{2}\tau_B$ and $\tau_C > 3\tau_B$.

38 Claims, 17 Drawing Sheets

TRI-LAYER THERMAL ACTUATOR AND METHOD OF OPERATING

FIELD OF THE INVENTION

The present invention relates generally to micro-electromechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electro-mechanical devices as actuators, valves, and posititioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and posititioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electrically resistive heaters to generate vapor bubbles which cause drop emission, as is discussed by Hara et al., in U.S. Pat. No. 4,296,421.

Electrically resistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combine the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,234,609; 6,239,821; and 6,243,113. Methods of manufacturing thermo-mechanical ink jet devices using microelectronic processes have been disclosed by K. Silverbrook in U.S. Pat. Nos. 6,254,793 and 6,274,056.

Thermo-mechanically actuated drop emitters are promising as low cost devices which can be mass produced using microelectronic materials and equipment and which allow operation with liquids that would be unreliable in a thermal ink jet device. However, operation of thermal actuator style drop emitters, at high drop repetition frequencies, requires careful attention to the effects of heat build-up. The drop generation event relies on creating a pressure impulse in the liquid at the nozzle. A significant rise in baseline temperature of the emitter device, and, especially, of the thermo-mechanical actuator itself, precludes system control of a portion of the available actuator displacement that can be achieved without exceeding maximum operating temperature limits of device materials and the working liquid itself. Apparatus and methods of operation for thermo-mechanical DOD emitters are needed which manage the effects of heat in the thermo-mechanical actuator so as to maximize the productivity of such devices.

A useful design for thermo-mechanical actuators is a cantilevered beam anchored at one end to the device structure with a free end that deflects perpendicular to the beam. The deflection is caused by setting up thermal expansion gradients in the beam in the perpendicular direction. Such expansion gradients may be caused by temperature gradients or by actual materials changes, layers, thru the beam. It is advantageous for pulsed thermal actuators to be able to establish the thermal expansion gradient quickly, and to dissipate it quickly as well, so that the actuator will restore to an initial position.

The repetition frequency of thermal actuations is important to the productivity of the devices that employ them. For example, the printing speed of a thermal actuator DOD ink jet printhead depends on the drop repetition frequency, which, in turn, depends on the time required to re-set the thermal actuator. Cantilevered element thermal actuators, which can be operated in a pulsed mode with rapid recovery, are needed in order to build systems that operate at high frequency and can be fabricated using EMS fabrication methods.

SUMMARY OF THE INVENTION

It is therefore an object of the present invention to provide a thermo-mechanical actuator which is operated in a pulsed mode and which resets quickly, allowing rapid repetion of the actuations.

It is also an object of the present invention to provide a liquid drop emitter which is actuated by a thermo-mechanical cantilever.

It is further an object of the present invention to provide a method of operating a thermo-mechanical actuator in an efficient manner such that repeated actuations have similar characteristics of motion.

The foregoing and numerous other features, objects and advantages of the present invention will become readily apparent upon a review of the detailed description, claims and drawings set forth herein. These features, objects and advantages are accomplished by constructing a thermal actuator for a micro-electromechanical device comprising a base element and a cantilevered element extending from the base element and normally residing at a first position before activation. The cantilevered element includes a barrier layer constructed of a low thermal conductivity material, bonded between a deflector layer and a restorer layer, both of which are constructed of materials having substantially equal coefficients of thermal expansion. The thermal actuator further comprises an apparatus adapted to apply a heat pulse directly to the deflector layer, causing a thermal expansion of the deflector layer relative to the restorer layer and deflection of the cantilevered element to a second position, followed by restoration of the cantilevered element to the first position as heat diffuses through the barrier layer to the restorer layer and the cantilevered element reaches a uniform temperature.

The present invention is particularly useful as a thermal actuator for liquid drop emitters used as printheads for DOD ink jet printing. In this preferred embodiment the thermal actuator resides in a liquid-filled chamber that includes a nozzle for ejecting liquid. The thermal actuator includes a cantilevered element extending from a wall of the chamber and a free end residing in a first position proximate to the nozzle. Application of a heat pulse to the cantilevered element causes deflection of the free end forcing liquid from the nozzle.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for a thermal actuator and a drop-on-demand liquid emission device and methods of operating same. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide apparatus and methods for operating drop emitters based on thermo-mechanical actuators so as to improve overall drop emission productivity.

Figure 1:
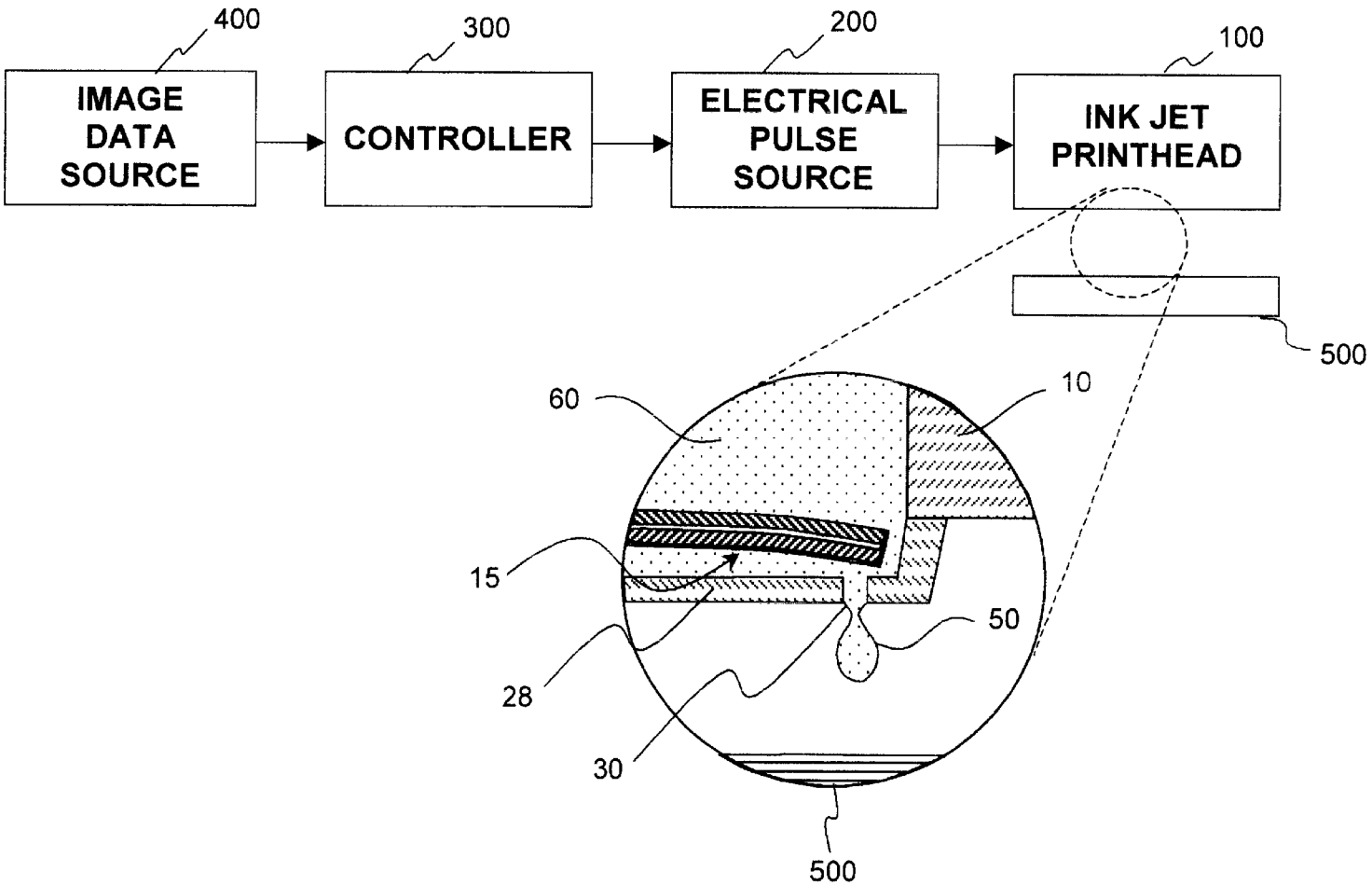
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermo-mechanical actuator 15 within ink jet printhead 100. The electrical energy pulses cause a thermo-mechanical actuator 15 (herein after "thermal actuator") to rapidly bend, pressurizing ink 60 located at nozzle 30, and emitting an ink drop 50 which lands on receiver 500. The present invention causes the emission of drops having substantially the same volume and velocity, that is, having volume and velocity within +/−20% of a nominal value. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 2:
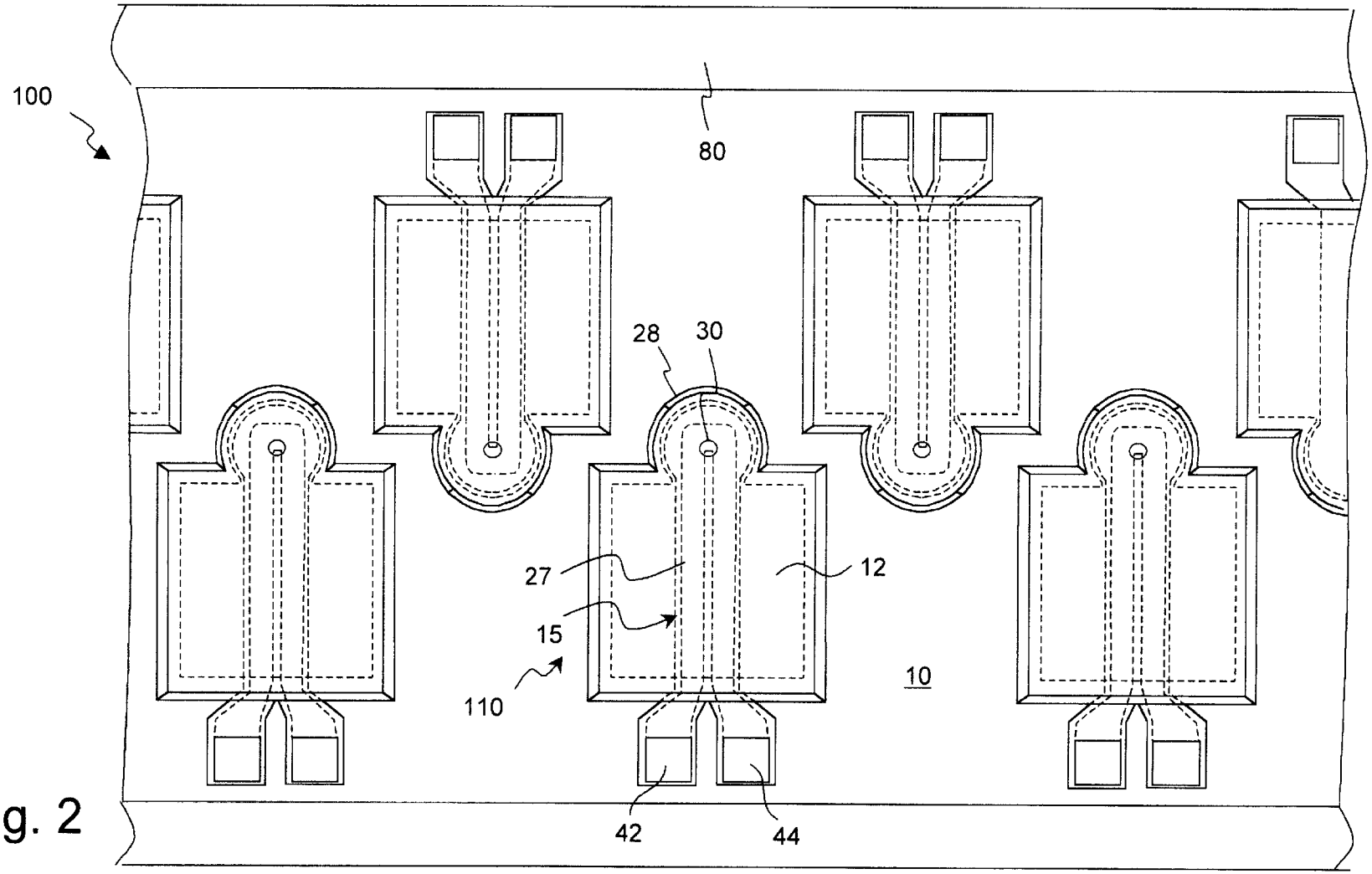
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in application Ser. No. 09/726,945 filed Nov. 30, 2000, for "Thermal Actuator", assigned to the assignee of the present invention.

Each drop emitter unit 110 has associated electrical lead contacts 42, 44 which are formed with, or are electrically connected to, a u-shaped electrically resistive heater 27, shown in phantom view in FIG. 2. In the illustrated embodiment, the resistor 27 is formed in a deflector layer of the thermal actuator 15 and participates in the thermomechanical effects as will be described. Element 80 of the printhead 100 is a mounting structure which provides a mounting surface for microelectronic substrate 10 and other means for interconnecting the liquid supply, electrical signals, and mechanical interface features.

Figure 3A:
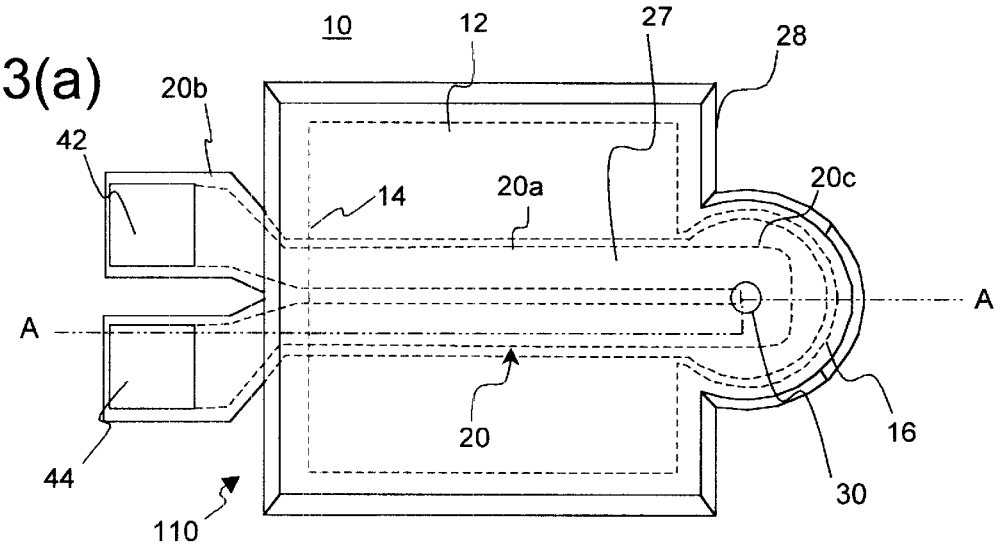
FIG. 3 is an enlarged plan view of an individual ink jet unit shown in FIG. 2.
Figure 3B:
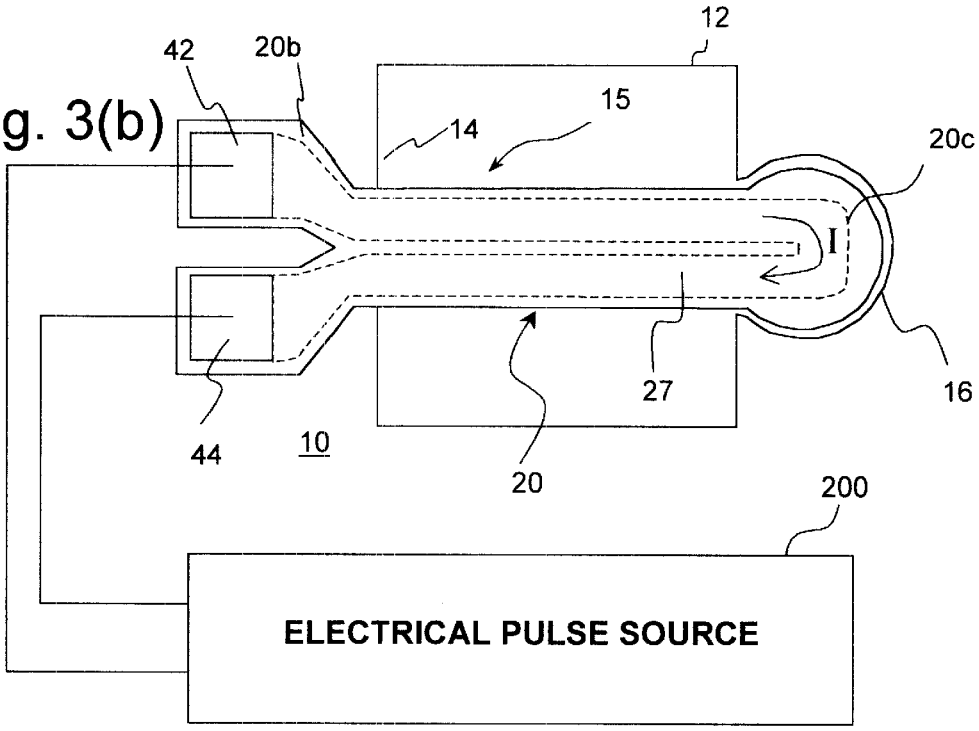

FIG. 3*a* illustrates a plan view of a single drop emitter unit 110 and a second plan view FIG. 3*b* with the liquid chamber cover 28, including nozzle 30, removed.

The thermal actuator 15, shown in phantom in FIG. 3*a* can be seen with solid lines in FIG. 3*b*. The cantilevered element 20 of thermal actuator 15 extends from edge 14 of liquid chamber 12 which is formed in substrate 10. Cantilevered element portion 20*b* is bonded to substrate 10 and anchors the cantilever.

The cantilevered element 20 of the actuator has the shape of a paddle, an extended flat shaft ending with a disc of larger diameter than the shaft width. This shape is merely illustrative of cantilever actuators which can bee used, many other shapes are applicable. The paddle shape aligns the nozzle 30 with the center of the actuator free end 20*c*. The fluid chamber 12 has a curved wall portion at 16 which conforms to the curvature of the actuator free end 20*c*, spaced away to provide clearance for the actuator movement.

FIG. 3*b* illustrates schematically the attachment of electrical pulse source 200 to the electrically resistive heater 27 at interconnect terminals 42 and 44. Voltage differences are applied to voltage terminals 42 and 44 to cause resistance heating via u-shaped resistor 27. This is generally indicated by an arrow showing a current 1. In the plan views of FIG. 3, the actuator free end 20*c* moves toward the viewer when pulsed and drops are emitted toward the viewer from the nozzle 30 in cover 28. This geometry of actuation and drop emission is called a "roof shooter" in many ink jet disclosures.

Figure 4A:
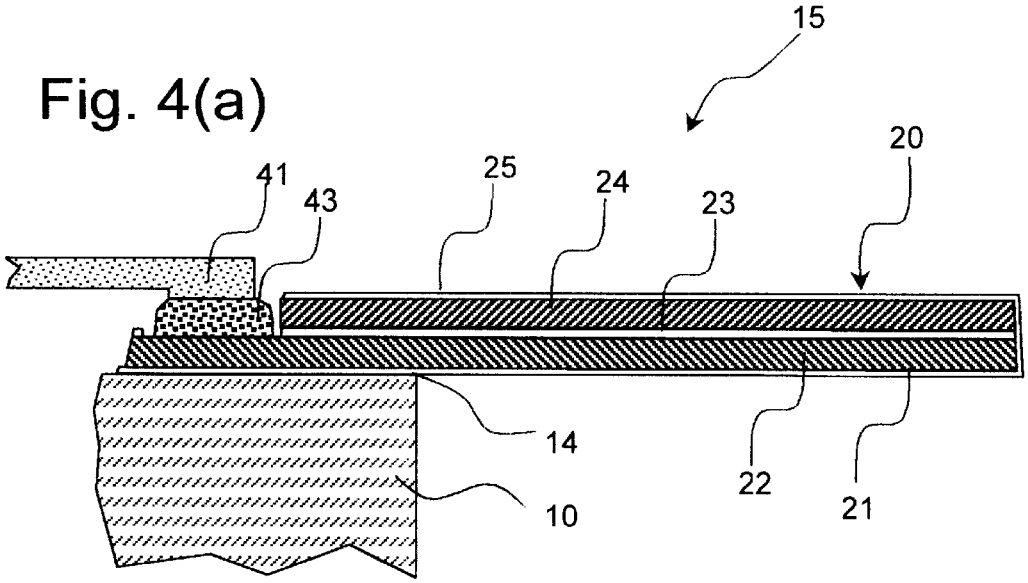
FIG. 4 is a side view illustrating the movement of a thermal actuator according to the present invention.
Figure 4B:
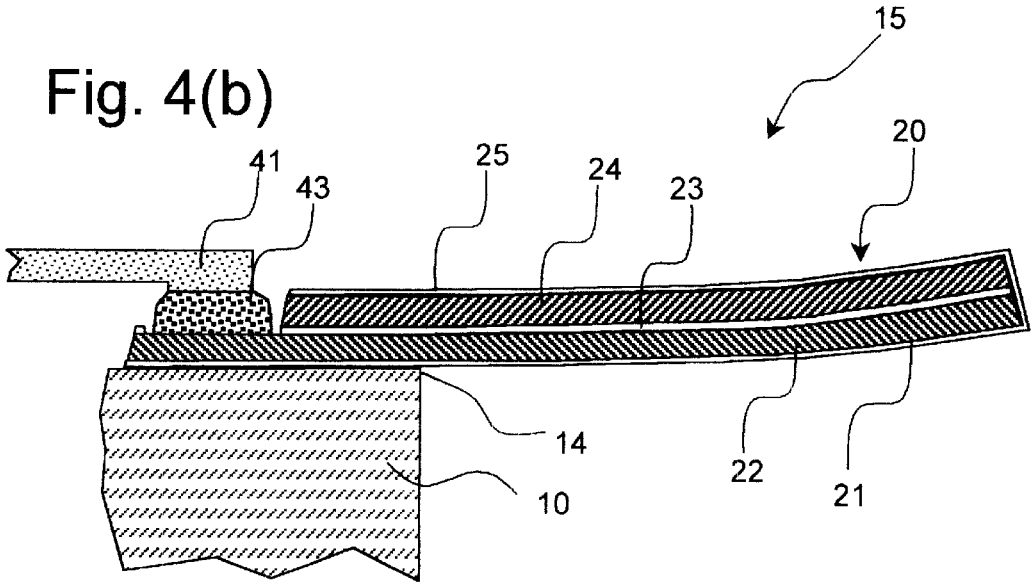

FIG. 4 illustrates in side view a cantilevered thermal actuator 15 according to a preferred embodiment of the present invention. In FIG. 4*a* the actuator is in a first position and in FIG. 4*b* it is shown deflected upward to a second position. Cantilevered element 20 is anchored to substrate 10 which serves as a base element for the thermal actuator. Cantilevered element extends from wall edge 14 of substrate base element 10.

Cantilevered element 20 is constructed of several layers. Layer 22 is the deflector layer which causes the upward deflection when it is thermally elongated with respect to other layers in the cantilevered element. Layer 24 is the restorer layer. This layer is constructed of materials that respond to temperature with substantially the same thermomechanical effect as the materials used to construct the deflector layer. The restorer layer mechanically balances the deflector layer when both are in thermal equilibrium. This balance many be readily achieved by using the same material for both the deflector layer 22 and the restorer layer 24. The balance may also be achieved by selecting materials having substantially equal coefficients of thermal expansion and other properties to be discussed hereinbelow.

The cantilevered element 20 also includes a barrier layer 23, interposed between the deflector layer 22 and restorer layer 24. The barrier layer 23 is constructed of a material having a low thermal conductivity with respect to the thermal conductivity of the material used to construct the deflector layer 24. The thickness and thermal conductivity of barrier layer 23 is chosen to provide a desired time constant $\tau_B$ for heat transfer from deflector layer 24 to restorer layer 22. Barrier layer 23 may also be a dielectric insulator to provide electrical insulation for an electrically resistive heater element used to heat the deflector layer. In some preferred embodiments of the present invention, a portion of the deflector layer itself is configured as an electroresistor. For these embodiments the barrier layer may be used to insulate and partially define the electroresistor.

Barrier layer 23 may be composed of sub-layers, laminations of more than one material, so as to allow optimization of functions of heat flow management, electrical isolation, and strong bonding of the layers of the cantilevered element 20.

Passivation layers 21 and 25 shown in FIG. 4 are provided to protect the cantilevered element 20 chemically and electrically. Such protection may not be needed for some applications of thermal actuators according to the present invention, in which case they may be deleted. Liquid drop emitters utilizing thermal actuators which are touched on one or more surfaces by the working liquid may require passivation layers 21 and 25 which are chemically and electrically inert to the working liquid.

A heat pulse is applied to deflector layer 22, causing it to rise in temperature and elongate. Restorer layer 24 does not elongate initially because barrier layer 23 prevents immediate heat transfer to it. The difference in temperature, hence, elongation, between deflector layer 22 and the restorer layer 24 causes the cantilevered element 20 to bend upward. When used as actuators in drop emitters the bending response of the cantilevered element 20 must be rapid enough to sufficiently pressurize the liquid at the nozzle. Typically, electrically resistive heating apparatus is adapted to apply heat pulses and an electrical pulse duration of less than 10 $\mu$secs. is used and, preferably, a duration less than 4 $\mu$secs.

FIGS. 5 through 10 illustrate fabrication processing steps for constructing a single liquid drop emitter according to some of the preferred embodiments: of the present invention. For these embodiments the deflector layer 22 is constructed using an electrically resistive material, such as titanium aluminide, and a portion is patterned into a resistor for carrying electrical current, I.

Figure 5:
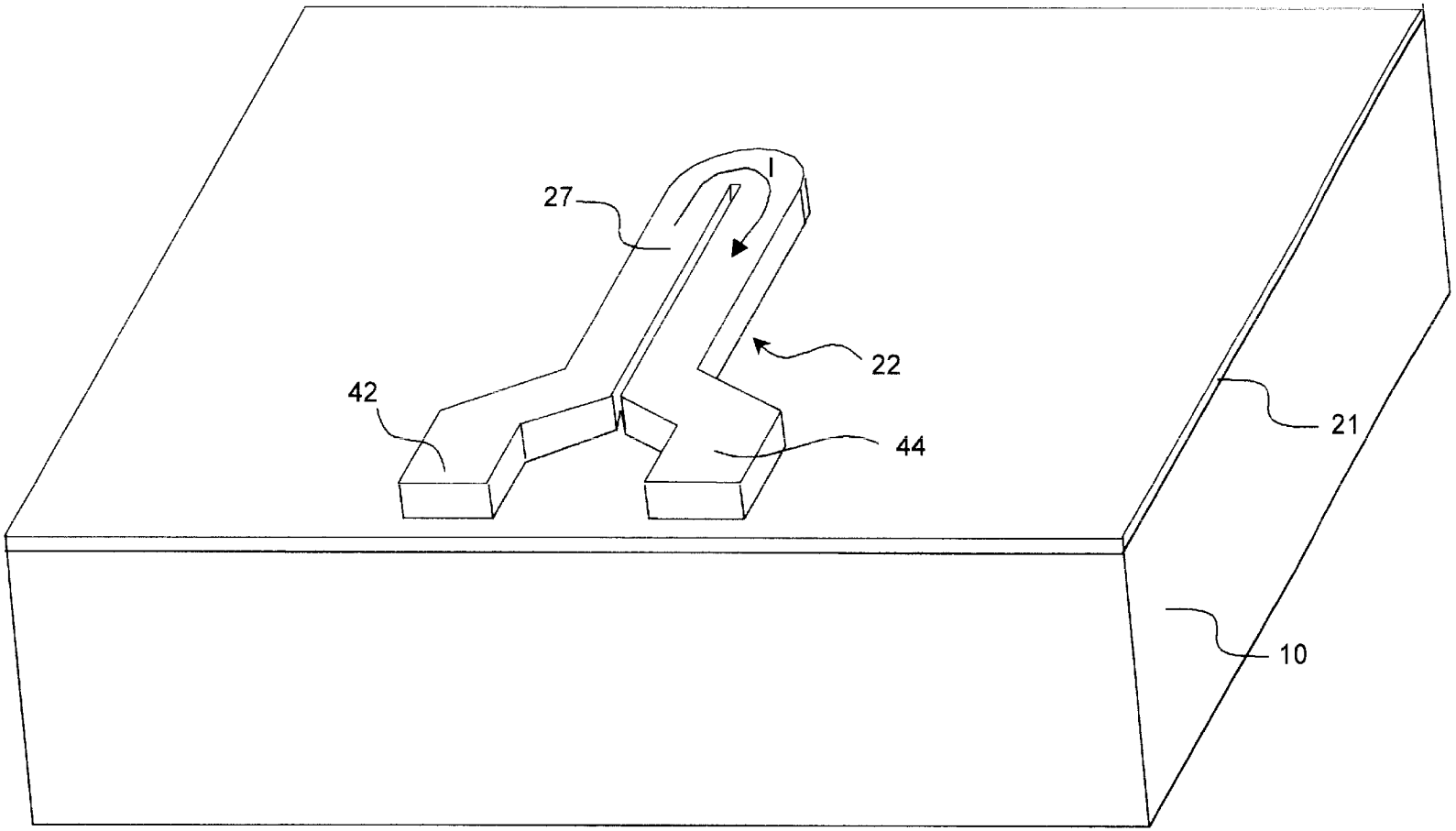
FIG. 5 is a perspective view of the early stages of a process suitable for constructing a thermal actuator according to the present invention wherein a deflector layer of the cantilevered element is formed.

FIG. 5 illustrates a deflector layer 22 portion of a cantilever in a first stage of fabrication. The illustrated structure is formed on a substrate 10, for example, single crystal silicon, by standard microelectronic deposition and patterning methods. Deposition of internetallic titanium aluminide may be carried out, for example, by RF or pulsed DC magnetron sputtering. A resistor 27 is patterned in deflector layer 22. The current path is indicated by an arrow and letter "I". Addressing electrical leads 42 and 44 are illustrated as being formed in the deflector layer 22 material. Leads 42, 44 may make contact with circuitry previously formed in substrate 10 or may be contacted externally by other standard electrical interconnection methods, such as tape automated bonding (TAB) or wire bonding. A passivation layer 21 is formed on substrate 10 before the deposition and patterning of the deflection layer material. This passivation layer may be left under deflection layer 22 and other subsequent structures or patterned away in a subsequent patterning process.

Figure 6:
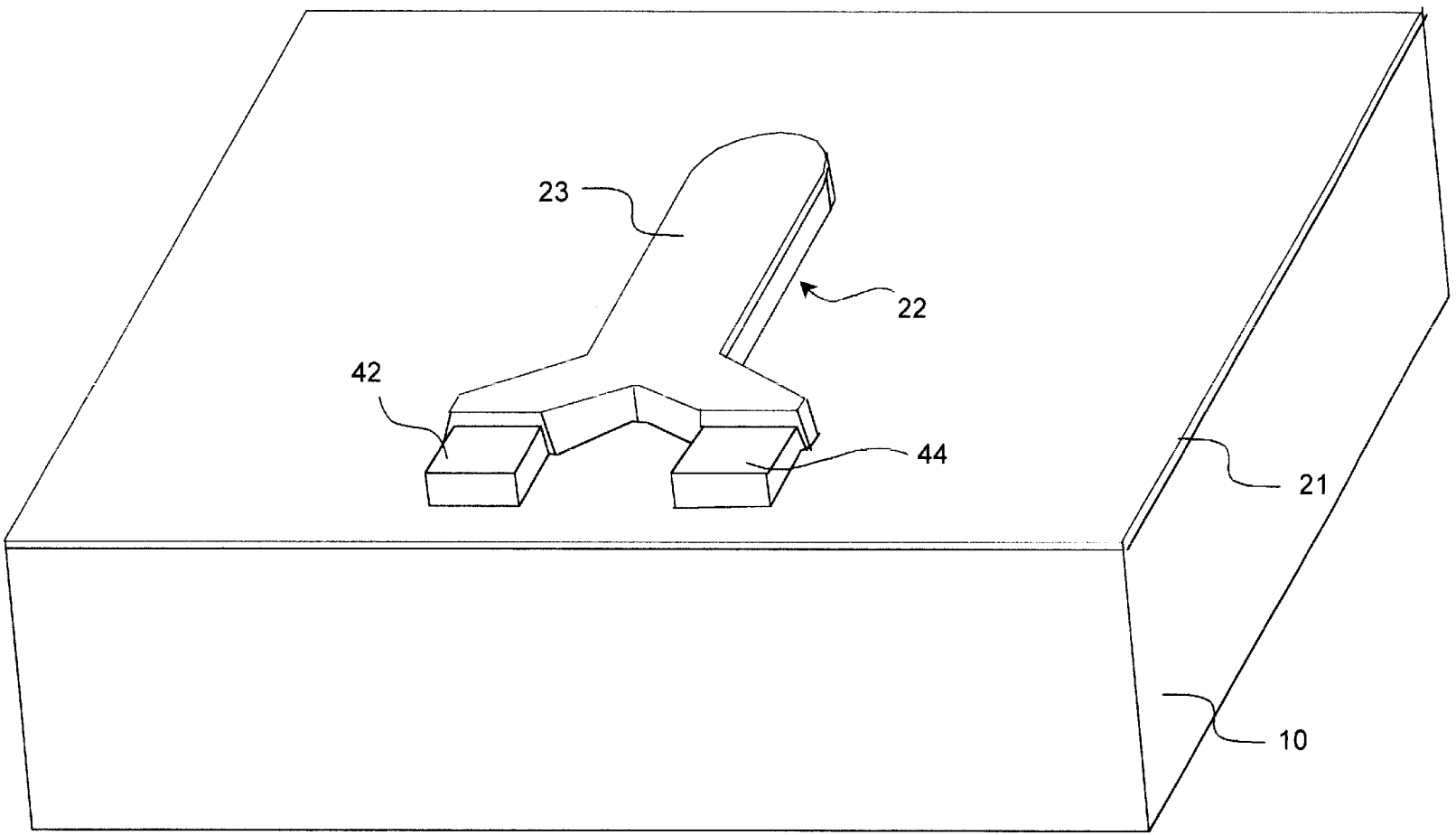
FIG. 6 is a perspective view of the next stages of the process illustrated in FIG. 5 wherein a barrier layer of the cantilevered element is formed.

FIG. 6 illustrates a barrier layer 23 having been deposited and patterned over the previously formed deflector layer 22 portion of the thermal actuator. The barrier layer 23 material has low thermal conductivity compared to the deflector layer 22. For example, barrier layer 23 may be silicon dioxide, silicon nitride, aluminum oxide or some multi-layered lamination of these materials or the like.

Favorable efficiency of the thermal actuator is realized if the barrier layer 23 material has thermal conductivity substantially below that of both the deflector layer 22 material and the restorer layer 24 material. For example, dielectric oxides, such as silicon oxide, will have thermal conductivity several orders of magnitude smaller than internetallic materials such as titanium aluminide. Low thermal conductivity allows the barrier layer 23 to be made thin relative to the deflector layer 22 and restorer layer 24. Heat stored by barrier layer 23 is not useful for the thermo-mechanical actuation process. Minimizing the volume of the barrier layer improves the energy efficiency of the thermal actuator and assists in achieving rapid restoration from a deflected position to a starting first position. The thermal conductivity of the barrier layer 23 material is preferably less than one-half the thermal conductivity of the deflector layer or restorer layer materials, and more preferably, less than one-tenth.

Figure 7:
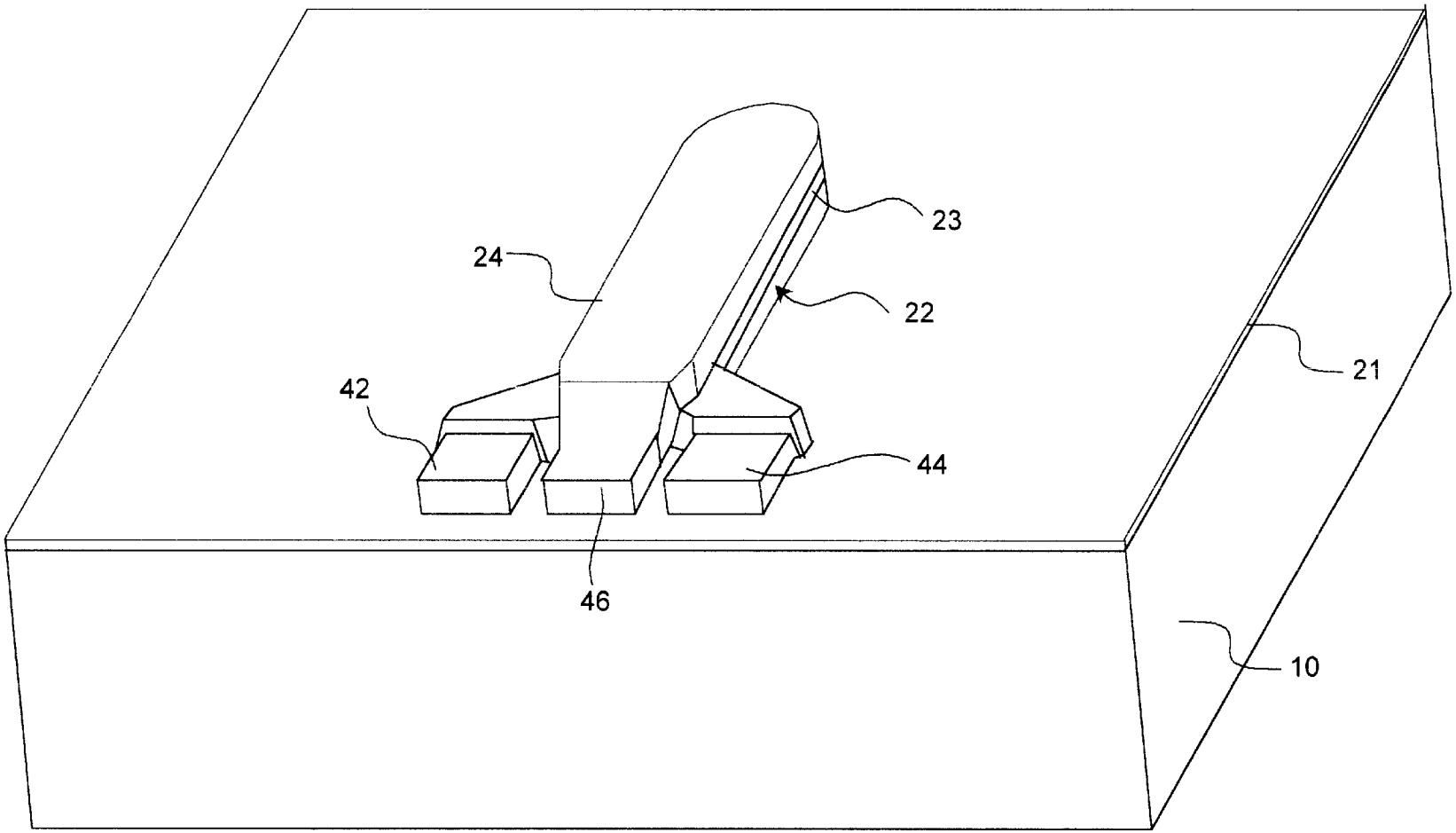
FIG. 7 is a perspective view of the next stages of the process illustrated in FIGS. 5 and 6 wherein a restorer layer of the cantilevered element is formed.

FIG. 7 illustrates a restorer layer 24 having been deposited and patterned over the previously formed barrier layer 23. For the illustrated embodiment, the restorer layer material is brought over the barrier layer to make thermal contact with substrate 10 at pad 46, patterned away from contact with leads 42, 44. In some preferred embodiments of the present invention, the same material, for example, intermetallic titanium aluminide, is used for both restorer layer 24 and deflector layer 22. In this case an intermediate masking step may be needed to allow patterning of the restorer layer 24 shape without disturbing the previously delineated deflector layer 22 shape. Alternately, barrier layer 23 may be fabricated using a lamination of two different materials, one of which is left in place protecting leads 42, 44 while patterning the restorer layer 24, and then removed to result in the cantilever element intermediate structure illustrated in FIG. 7.

Additional passivation materials may be applied at this stage over the restorer layer for chemical and electrical protection. Also, the initial passivation layer 21 is patterned away from areas through which fluid will pass from openings to be etched in substrate 10.

Figure 8:
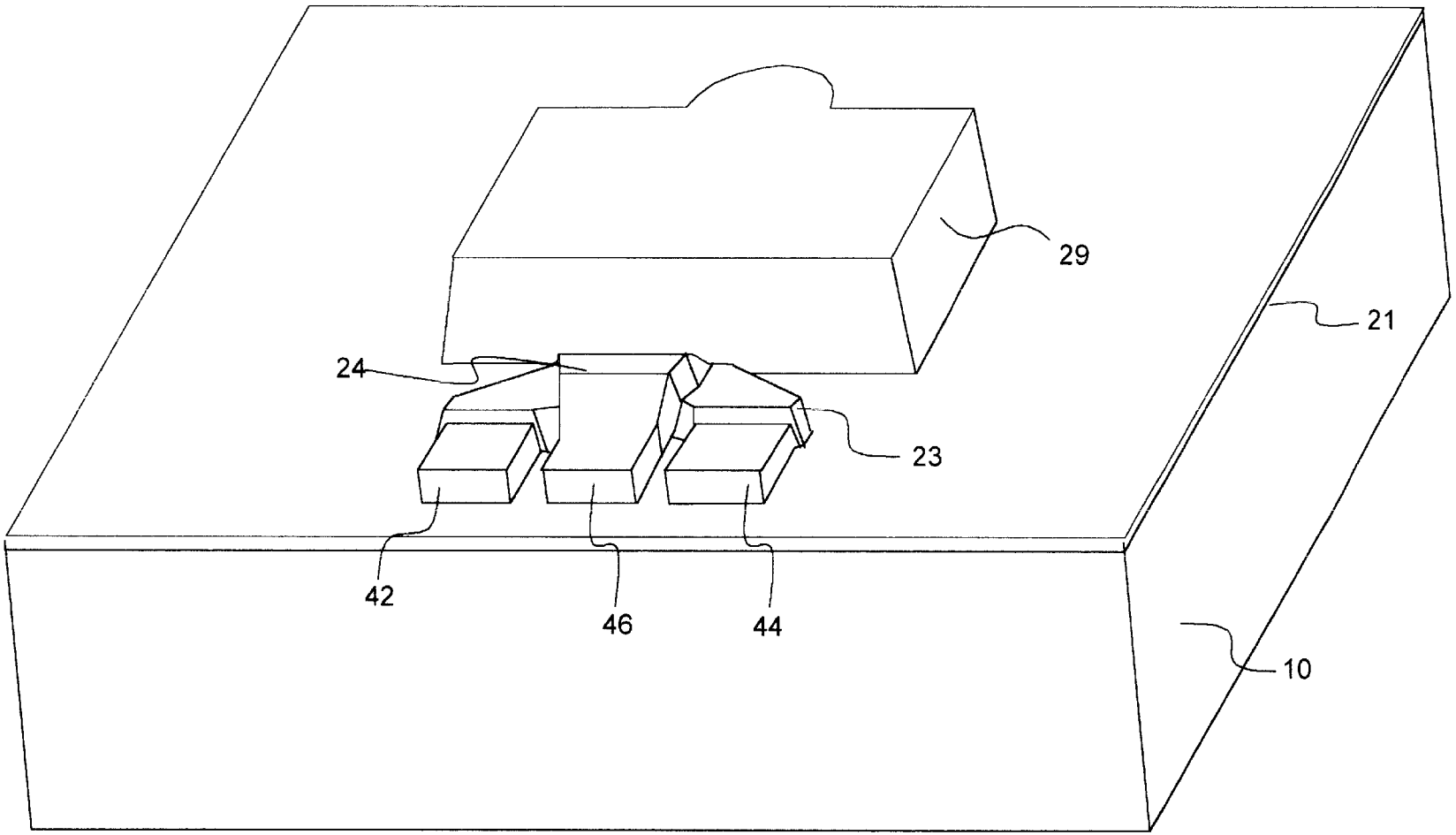
FIG. 8 is a perspective view of the next stages of the process illustrated in FIGS. 5–7 wherein a sacrificial layer in the shape of the liquid filling a chamber of a drop emitter according to the present invention is formed.

FIG. 8 shows the addition of a sacrificial layer 29 which is formed into the shape of the interior of a chamber of a liquid drop emitter. A suitable material for this purpose is polyimide. Polyimide is applied to the device substrate in sufficient depth to also planarize the surface which has the topography of the deflector 22, barrier 23 and restorer layers 24 as illustrated in FIG. 7. Any material which can be selectively removed with respect to the adjacent materials may be used to construct sacrificial structure 29.

Figure 9:
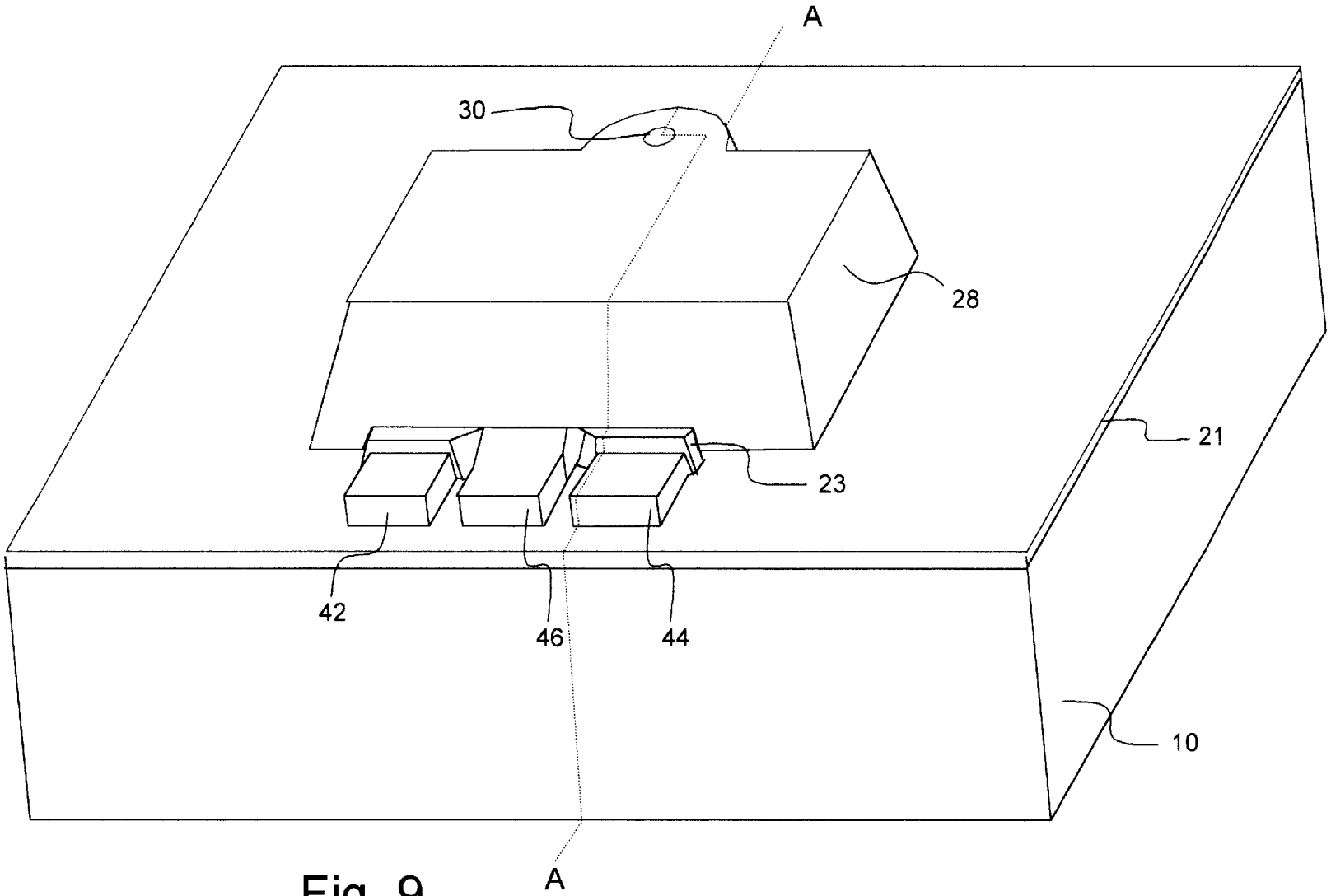
FIG. 9 is a perspective view of the next stages of the process illustrated in FIGS. 5–8 wherein a liquid chamber and nozzle of a drop emitter according to the present invention is formed.

FIG. 9 illustrates drop emitter liquid chamber walls and cover formed by depositing a conformal material, such as plasma deposited silicon oxide, nitride, or the like, over the sacrificial layer structure 29. This layer is patterned to form drop emitter chamber 28. Nozzle 30 is formed in the drop emitter chamber, communicating to the sacrificial material layer 29, which remains within the drop emitter chamber 28 at this stage of the fabrication sequence.

Figure 10A:
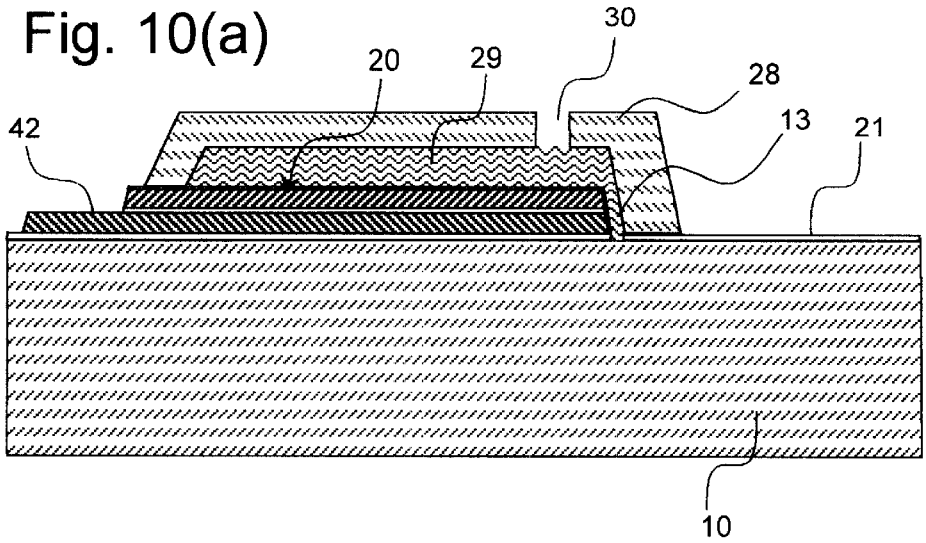
FIG. 10 is a side view of the final stages of the process illustrated in FIGS. 5–10 wherein a liquid supply pathway is formed and the sacrificial layer is removed to complete a liquid drop emitter according to the present invention.

FIG. 10 shows a side view of the device through a section indicated as A—A in FIG. 9. In FIG. 10*a* the sacrificial layer 29 is enclosed within the drop emitter chamber wails 28 except for nozzle opening 30. Also illustrated in FIG. 10*a*, the substrate 10 is intact. Passivation layer 21 has been removed from the surface of substrate 10 in gap area 13 and around the periphery of the cantilevered element 20. The removal of layer 21 in these locations was done at a fabrication stage before the forming of sacrificial structure 29.

Figure 10B:
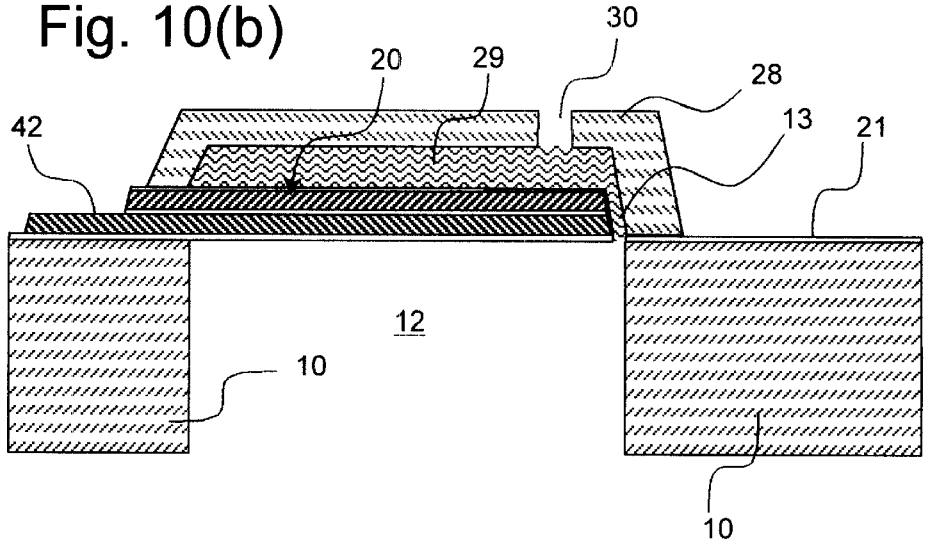

In FIG. 10*b*, substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element.

Figure 10C:
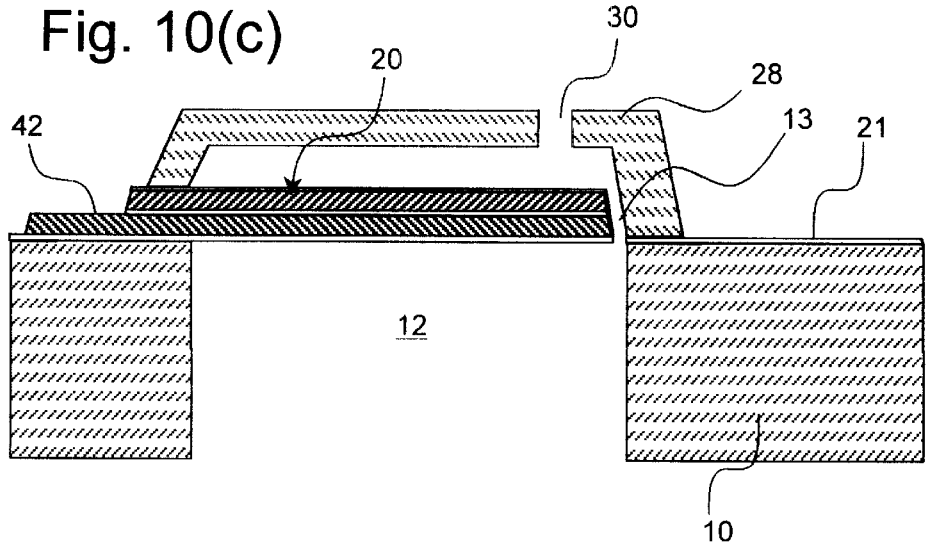

In FIG. 10*c* the sacrificial material layer 29 has been removed by dry etching using oxygen and fluorine sources. The etchant gasses enter via the nozzle 30 and from the newly opened fluid supply chamber area 12, etched previously from the backside of substrate 10. This step releases the cantilevered element 20 and completes the fabrication of a liquid drop emitter structure.

Figure 11:
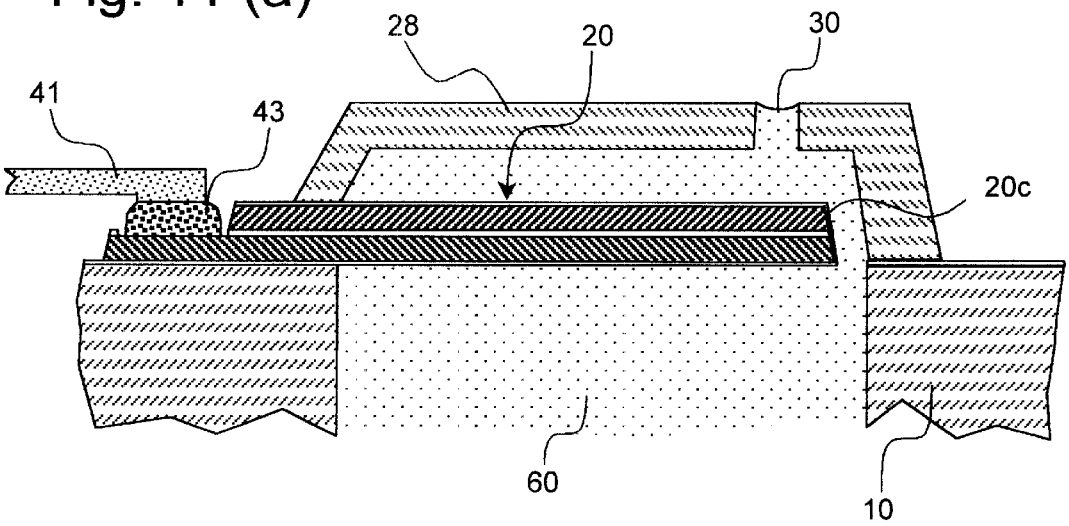
FIG. 11 is a side view illustrating the operation of a drop emitter according the present invention.
Figure 11:
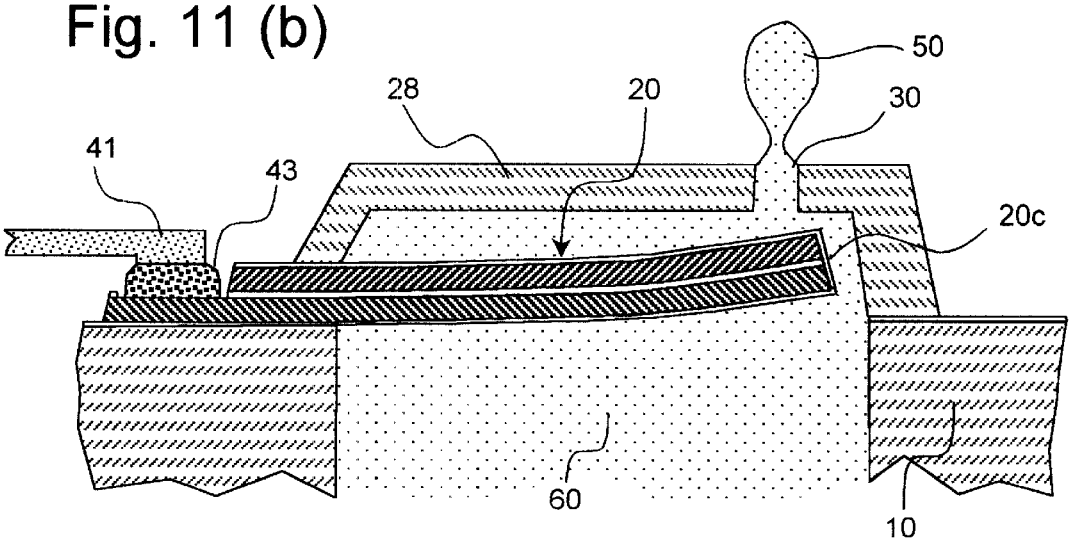

FIG. 11 illustrates a side view of a liquid drop emitter structure according to some preferred embodiments of the present invention. FIG. 11*a* shows the cantilevered element 20 in a first position proximate to nozzle 30. FIG. 11*b* illustrates the deflection of the free end 20*c* of the cantilevered element 20 towards nozzle 30. Rapid deflection of the cantilevered element to this second position pressurizes liquid 60 causing a drop 50 to be emitted.

In an operating emitter of the cantilevered element type illustrated, the quiescent first position may be a partially bent condition of the cantilevered element 20 rather than the horizontal condition illustrated FIG. 11*a*. The actuator may be bent upward or downward at room temperature because of internal stresses that remain after one or more microelectronic deposition or curing processes. The device may be operated at an elevated temperature for various purposes, including thermal management design and ink property control. If so, the first position may be as substantially bent as is illustrated in FIG. 11*b*.

For the purposes of the description of the present invention herein, the cantilevered element will be said to be quiescent or in its first position when the free end is not significantly changing in deflected position. For ease of understanding, the first position is depicted as horizontal in FIG. 4*a* and FIG. 11*a*. However, operation of thermal actuators about a bent first position are known and anticipated by the inventors of the present invention and are fully within the scope of the present inventions.

FIGS. 5 through 10 illustrate a preferred fabrication sequence. However, many other construction approaches may be followed using well known microelectronic fabrication processes and materials. For the purposes of the present invention, any fabrication approach which results in a cantilevered element including a deflection layer 22, a barrier layer 23, and a restorer layer 24 may be followed. Further, in the illustrated sequence of FIGS. 5 through 10, the liquid chamber 28 and nozzle 30 of a liquid drop emitter were formed in situ on substrate 10. Alternatively a thermal actuator could be constructed separately and bonded to a liquid chamber component to form a liquid drop emitter.

Figure 12:
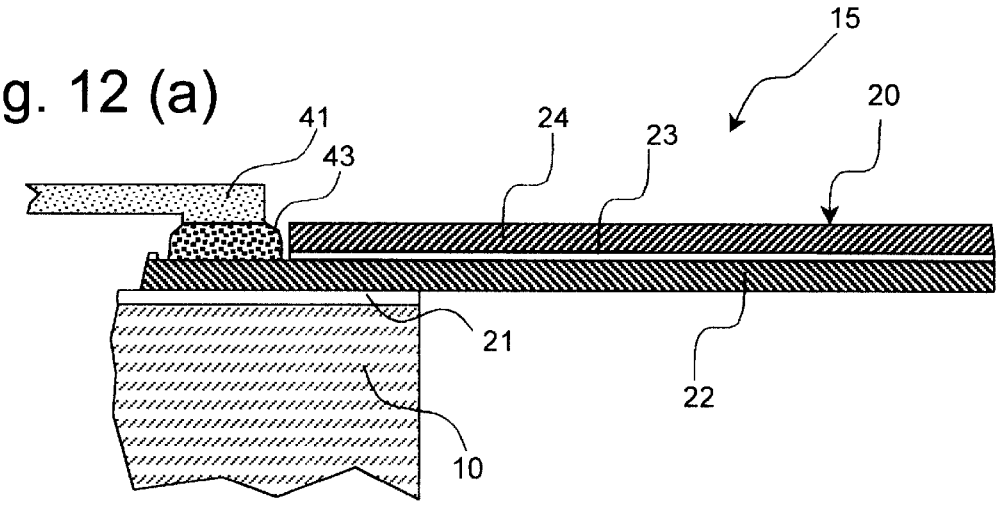
FIG. 12 is a side view illustrating three preferred embodiments of apparatus adapted to apply heat according to the present invention.
Figure 12:
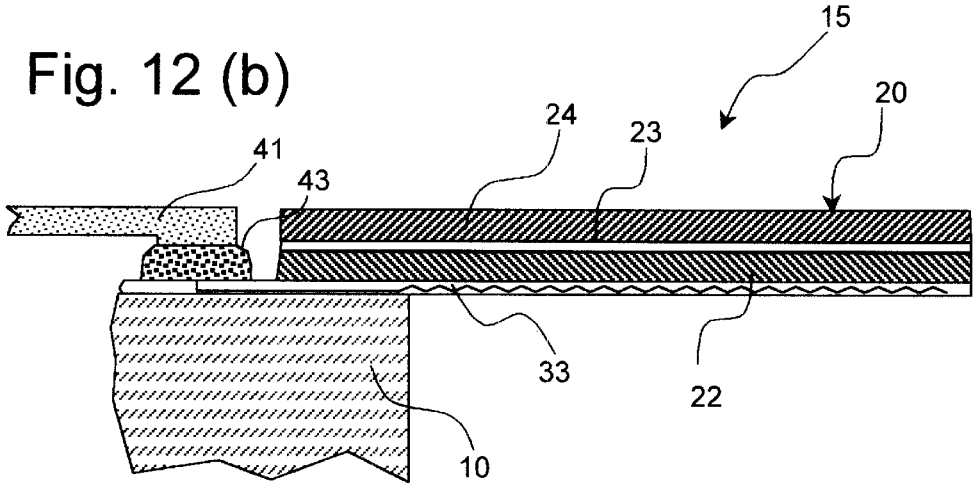
Figure 12:
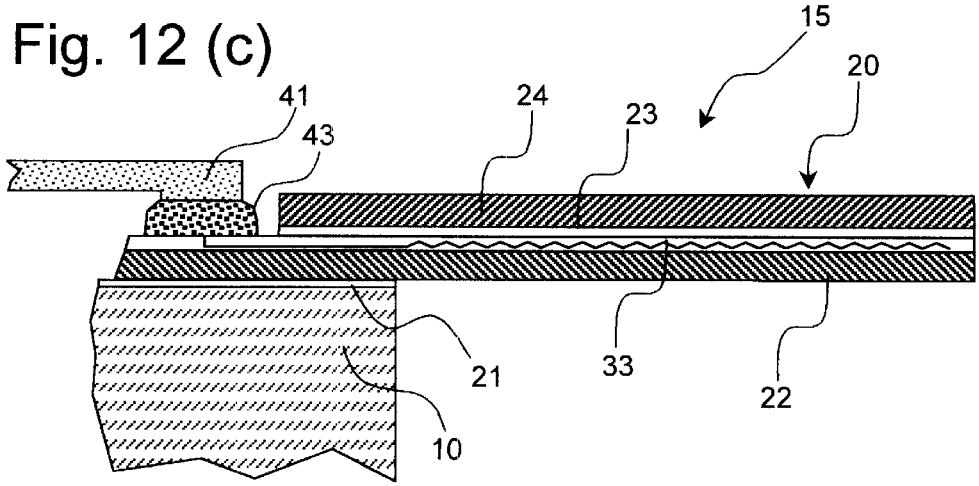

FIGS. 5 through 10 illustrate preferred embodiments in which the deflector layer is formed of an electrically resistive material. A portion of deflector layer 22 is formed into a resistor portion 27 carrying current when an electrical pulse is applied to leads 42, 44, thereby heating directly the deflector layer 22. In other preferred embodiments of the present inventions, the deflector layer 22 is heated by other apparatus adapted to apply heat to either side of the deflector layer. For example, a thin film resistor structure can be formed first on substrate 10 and then deflector layer 22 formed on it. Or, a thin film resistor structure can be formed on top of the deflector layer 22 and then the barrier layer 23 formed on top of the thin film resistor structure. These three approaches to applying heat to the deflector layer 22 by electrically resistive means are illustrated in FIG. 12.

In FIG. 12*a* the deflector layer 22 incorporates an electrically resistive heater portion. Electrical pulses are applied via TAB lead 41 and solder bump 43 to leads 42, 44 of the electrically resistive deflector layer 22 . In FIG. 12*b* a thin film heater resistor structure 33 is positioned at the lower surface of the deflector layer 22. Electrical connection is made to thin film heater 33 via TAB lead 41 and solder bump 43. In FIG. 12*c* a thin film heater resistor structure 33 is positioned at the interface between the barrier layer 23 and the deflector layer 22. Electrical connection is made to thin film heater 33 via TAB lead 41 and solder bump 43.

It is important to apply heat energy directly to the deflector layer 22 via good thermal contact means in order to maximize the temperature differential created with respect to the restorer layer. There may need to be an electrically insulating layer between an electrically resistive material used to generate heat energy and the deflector material, especially if the deflector material is metallic or semiconducting. Good thermal contact is needed between an apparatus adapted to supply heat and the deflector layer 22 so that rapid heating can be accomplished.

Barrier layer 22 allows interlayer heat transfer with a characteristic time constant of $\tau_B$. For efficient operation of thermal actuators according to the present invention, the heat applied to deflector layer 22 is preferably introduced in a time less than $\tau_B$, and, most preferably in a time less than $\frac{1}{2}\tau_B$. The terms "directly to" and "good thermal contact", as applied to an apparatus adapted to supply heat to the deflector layer 22, are to be understood in the context of this preferred timing. Such apparatus are adapted to have sufficiently intimate thermal contact and power capabilities so as to supply the required heat energy within a time period that is on the order of $\tau_B$ or less. Heat may be a plied more slowly, however, desirable actuator performance characteristics such as maximum deflection, deflection force, and deflection repetition rate will be significantly diminished.

Heat may be introduced to the deflector layer 2 by apparatus other than by electrical resistors. Pulses of light energy could be absorbed by deflector layer 22 or energy applied via electromagnetic inductive coupling. Any apparatus which can be adapted to transfer pulses of heat energy to the deflector layer 22 are anticipated as viable means for practicing the present invention.

The flow of heat within cantilevered element 0 is a primary physical process underlying the present inventions. FIG. 1 illustrates heat flows by means of arrows designating internal heat flow, $Q_l$, and flow to the surroundings, $Q_s$. Cantilevered element 20 bends, deflecting ee end 20*c*, because deflector layer 22 is made to elongate with respect to restore layer 24 by the addition of a heat pulse to the deflector layer. In general, thermal actuators of the cantilever configuration may be designed to have large differences in the coefficients of thermal expansion at a uniform operating temperature, to operate with a large temperature differential within the actuator, or some combination of both. The present inventions are designed to utilize and maximize an internal temperature differential set up between the deflector layer 22 and restorer layer 24.

In the preferred embodiments, the deflector an restorer layers are constructed using materials having substantially equal coefficients of thermal expansion over the temperature range of operation of the thermal actuator Therefore, maximum actuator deflection occurs when the maximum temperature difference between the deflector layer 22 and restorer layer 4 is achieved. Restoration of the actuator to a first or nominal position then will occur when the temperature equilibrates among deflector 22, restorer 24 and barrier 23 layers. The temperature equilibration process is mediated by the characteristics of the barrier layer 23, primarily its thickness, Young's modulus, coefficient of thermal expansion and thermal conductivity.

As has been previously stated, for the purposes of the present inventions, it is desirable that the restorer layer 24 mechanically balance the deflector layer 22 when internal thermal equilibrium is reached following a heat pulse which initially heats deflector layer 22. Mechanical balance at thermal equilibrium is achieved by the design of the thicknesses and the materials properties of the layers of the cantilevered element, especially the coefficients of thermal expansion and Young's moduli. The full analysis of the thermomechanical effects is very complex for the situation of arbitrary values for all of the parameters of a tri-layer cantilevered element. The present invention may be understood by considering the net deflection for a tri-layer beam structure at an equilibrium temperature.

A cantilevered tri-layer structure comprised of deflector, barrier and restorer layers having different materials properties and thicknesses, assumes a parabolic arc shape. The deflection D of the free end of the cantilever, as a function of temperature above a base temperature ΔT, is proportional to the materials properties and thicknesses according to the following relationships:

$$D \propto M\Delta T, \tag{1}$$

where, $$M = \frac{1}{G}\left\{E_d(\alpha-\alpha_d)\left[\left(\frac{h_b}{2}\right)^2-\left(\frac{h_b}{2}+h_d\right)^2\right]+E_r(\alpha-\alpha_r)\left[\left(\frac{h_b}{2}+h_r\right)^2-\left(\frac{h_b}{2}\right)^2\right]\right\} \tag{2}$$

$$\text{and } \alpha = \frac{E_d\alpha_d h_d + E_b\alpha_b h_b + E_r\alpha_r h_r}{E_d h_d + E_b h_b + E_r h_r}. \tag{3}$$

The subscripts d, b and r refer to the deflector, barrier and restorer layers, respectively. $E_j$, $\alpha_j$, and $h_j$ (j=d, b, or r) are the Young's modulus, coefficient of thermal expansion and thickness, respectively, for the $j^{th}$ layer. The parameter G is a function of the elastic parameters and dimensions of the various layers and is always a positive quantity. Exploration of the parameter G is not needed for determining when the tri-layer beam could have a net zero deflection at an elevated temperature for the purpose of understanding the present inventions.

The important quantity M in Equations 1 and 2 captures effects of materials properties and thicknesses of the layers. The tri-layer cantilever will have a net zero deflection, D=0, for an elevated value of ΔT, if M=0. Examining Equation 2 the condition M=0 occurs when:

$$E_d(\alpha-\alpha_d)\left[\left(\frac{h_b}{2}\right)^2-\left(\frac{h_b}{2}+h_d\right)^2\right]=E_r(\alpha-\alpha_r)\left[\left(\frac{h_b}{2}\right)^2-\left(\frac{h_b}{2}+h_r\right)^2\right]. \quad (4)$$

For the special case when layer thicknesses, $h_d=h_r$, coefficients of thermal expansion, $\alpha_d=\alpha_r$, and Young's moduli, $E_d=E_r$, the quantity M is zero and there is zero net deflection.

It may be understood from Equation 2 that if the restorer layer 24 material is the same as the deflector layer 22 material, then the tri-layer structure will have a net zero deflection if the thickness $h_d$ of deflector layer 22 is substantially equal to the thickness $h_r$ of restorer layer 24.

It may also be understood from Equation 2 there are many other combinations of the parameters for the restorer layer 24 and barrier layer 23 which may be selected to provide a net zero deflection for a given deflector layer 22. For example, some variation in restorer layer 24 thickness, Young's modulus, or both, may be used to compensate for different coefficients of thermal expansion between restorer layer 24 and deflector layer 22 materials.

All of the combinations of the layer parameters captured in Equations 1–4 that lead to a net zero deflection for the tri-layer structure at an elevated temperature ΔT are anticipated by the inventors of the present inventions as viable embodiments of the present inventions.

Figure 13:
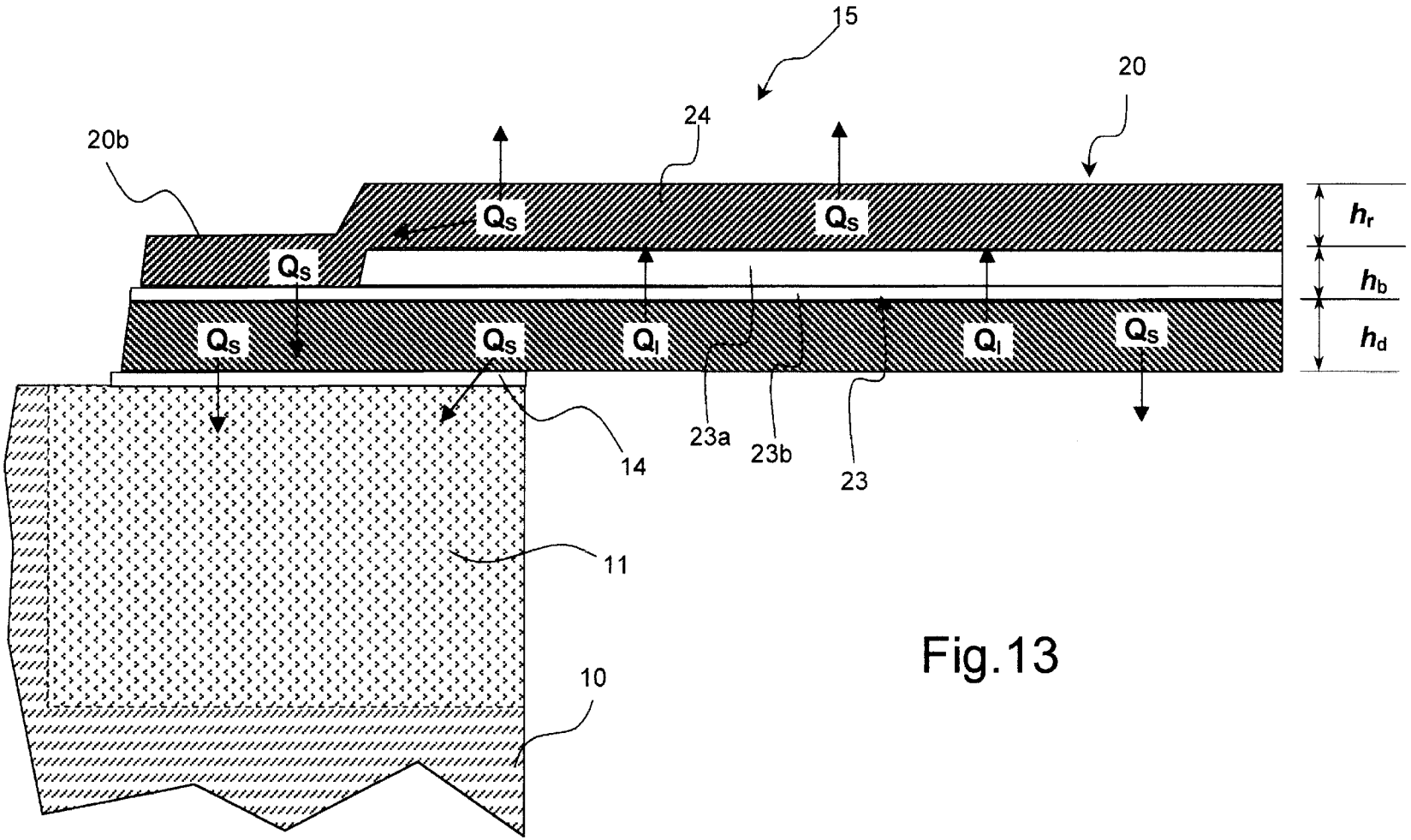
FIG. 13 is a side view illustrating heat flows within and out of a cantilevered element according to the present invention.

The internal heat flows $Q_I$ illustrated in FIG. 13 are driven by the temperature differential among layers. For the purpose of understanding the present inventions, heat flow from a deflector layer 22 to a restorer layer 24 may be viewed as a heating process for the restorer layer 24 and cooling process for the deflector layer 22. Barrier layer 23 may be viewed as establishing a time constant, $\tau_B$, for heat transfer in both heating and cooling processes. The time constant $\tau_B$ is approximately proportional to the thickness $h_b$ of the barrier layer 23 and inversely proportional to the thermal conductivity of the materials used to construct this layer. As noted previously, the heat pulse input to deflector layer 22 must be shorter in duration than the heat transfer time constant, otherwise the potential temperature differential and deflection magnitude will be dissipated by excessive heat loss through the barrier layer 23.

A second heat flow ensemble, from the cantilevered element to the surroundings, is indicated by arrows marked $Q_s$. The details of the external heat flows will depend importantly on the application of the thermal actuator. Heat may flow from the actuator to substrate 10, or other adjacent structural elements, by conduction. If the actuator is operating in a liquid or gas, it will lose heat via convection and conduction to these fluids. Heat will also be lost via radiation. For purpose of understanding the present inventions, heat lost to the surrounding may be characterized as a single external cooling time constant $\tau_S$ which integrates the many processes and pathways that are operating.

A final timing parameter of importance is the desired repetition period, $\tau_C$, for operating the thermal actuator. For example, for a liquid drop emitter used in an ink jet printhead, the actuator repetion period establishes the drop firing frequency, which establishes the pixel writing rate that a jet can sustain. Since the heat transfer time constant $\tau_B$ governs the time required for the cantilevered element to restore to a first position, it is preferred that $\tau_B \ll \tau_C$ for energy efficiency and rapid operation. Uniformity in actuation performance from one pulse to the next will improve as the repetition period $\tau_C$ is chosen to be several units of $\tau_B$ or more. That is, if $\tau_C > 5\ \tau_B$ then the cantilevered element will have fully equilibrated and returned to the first or nominal position. If, instead $\tau_C < 2\ \tau_B$, then there will be some significant amount of residual deflection remaining when a next deflection is attempted. It is therefore desirable that $\tau_C > 2\ \tau_B$ and more preferably that $\tau_C > 4\ \tau_B$.

The time constant of heat transfer to the surround, $\tau_S$, may influence the actuator repetition period, $\tau_C$, as well. For an efficient design, $\tau_S$ will be significantly longer than $\tau_B$. Therefore, even after the cantilevered element has reached internal thermal equilibrium after a time of 3 to 5 $\tau_B$, the cantilevered element will be above the ambient temperature or starting temperature, until a time of 3 to 5 $\tau_S$. A new deflection may be initiated while the actuator is still above ambient temperature. However, to maintain a constant amount of mechanical actuation, higher and higher peak temperatures for the deflector layer 22 will be required. Repeated pulsing at periods $\tau_C < 3\ \tau_S$ will cause continuing rise in the maximum temperature of the actuator materials until some failure mode is reached.

A heat sink portion 11 of substrate 10 is illustrated in FIG. 13. When a semiconductor or metallic material such as silicon is used for substrate 10, the indicated heat sink portion 11 may be simply a region of the substrate 10 designated as a heat sinking location. Alternatively, a separate material may be included within substrate 10 to serve as an efficient sink for heat conducted away from the cantilevered element 20 at the anchor portion 20*b*.

Figure 14:
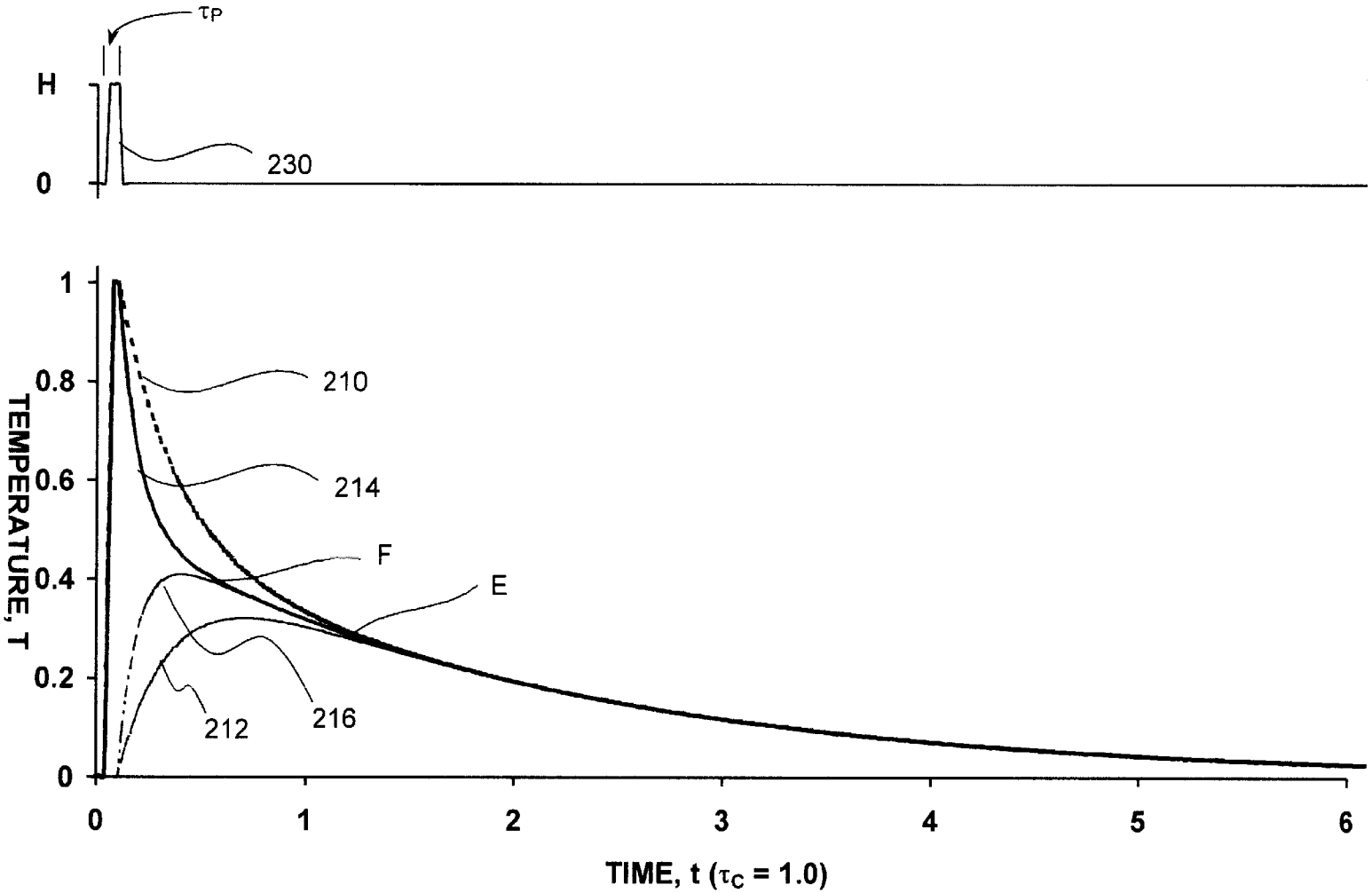
FIG. 14 is a plot of temperature versus time for deflector and restorer layers for two configurations of the barrier layer of a cantilevered element according to the present invention.

FIG. 14 illustrates the timing of heat transfers within the cantilevered element 20 and from the cantilevered 20 to the surrounding structures and materials. Temperature, T, is plotted on a scale normalized over the intended range of temperature excursion of the deflector layer 22 above its steady state operating temperature. That is, T=1 in FIG. 14 is the maximum temperature reached by the deflector layer after a heat pulse has been applied and T=0 in FIG. 14 is the base or steady state temperature of the cantilevered element. The time axis of FIG. 14 is plotted in units of $\tau_C$, the minimum time period for repeated actuations. Also illustrated in FIG. 14 is a heating pulse 230 having a pulse duration time of $\tau_P$. Heating pulse 230 is applied to deflector layer 22.

FIG. 14 shows four plots of temperature, T, versus time, t. Curves for the restorer layer 24 and for the deflector layer 22 are plotted for cantilevered element configurations having two different values of the heat transfer time constant $\tau_B$. A single value for the heat transfer time constant, $\tau_S$, was used for all four temperature curves. One-dimensional, exponential heating and cooling functions are assumed to generate the temperature versus time plots of FIG. 14.

In FIG. 14, curve 210 illustrates the temperature of the deflector layer 22 and curve 212 illustrates the temperature of the restorer layer 24 following a heat pulse applied to the deflector layer 22. For curves 210 and 212, the barrier layer 23 heat transfer time constant is $\tau_B=0.3\ \tau_C$ and the time constant for cooling to the surround, $\tau_S=2.0\ \tau_C$. FIG. 14 shows the restorer layer 24 temperature 212 rising as the deflector layer 22 temperature 210 falls, until internal equilibrium is reached at the point denoted E. After point E, the temperature of both layers 22 and 24 continues to decline together at a rate governed by $\tau_S$=2.0 $\tau_C$. The amount of deflection of the cantilevered element is approximately proportional to the difference between deflector layer temperature 210 and restorer layer temperature 212. Hence, the cantilevered element will be restored from it deflected position to the first position at the time and temperature denoted as E in FIG. 14.

The second pair of temperature curves, 214 and 216, illustrate the deflector layer temperature and restorer layer temperature, respectively, for the case of a shorter barrier layer time constant, $\tau_B$=0.1 $\tau_C$. The surround cooling time constant for curves 214 and 216 is also $\tau_S$=2.0 $\tau_C$ as for curves 210 and 212. The point of internal thermal equilibrium within cantilevered element 20 is denoted F in FIG. 14. Hence, the cantilevered element will be restored from its deflection position to the first position at the time and temperature denoted as F in FIG. 14.

It may be understood from the illustrative temperature plots of FIG. 14 that it is advantageous that $\tau_B$ is small with respect to $\tau_C$ in order that the cantilevered element is restored to its first or nominal position before a next actuation is initiated. If a next actuation were initiated at time t=1.0 $\tau_C$, it can be understood from equilibrium points E and F that the cantilevered element would be fully restored to its first position when $\tau_B$=0.1 $\tau_C$. If $\tau_B$=0.3 $\tau_C$, however, it would be starting from a somewhat deflected position, indicated by, the small temperature difference between curves 210 and 212 at time t=1.0 $\tau_C$.

FIG. 14 also illustrates that the cantilevered element 20 will be at an elevated temperature even after reaching internal thermal equilibrium and restoration of the deflection to the first position. The cantilevered element 20 will be elongated at this elevated temperature but not deflected due to a balance of forces between the deflector layer 22 and restorer layer 24. The cantilevered element may be actuated from this condition of internal thermal equilibrium at an elevated temperature. However, continued application of heat pulses and actuations from such elevated temperature conditions may cause failure modes to occur as various materials in the device or working environment begin to occur as peak temperature excursions also rise. Consequently, it is advantageous to reduce the time constant of heat transfer to the surround, $\tau_S$, as much as possible.

The cantilever configuration of the present invention offers an opportunity to reduce the overall cooling time constant, $\tau_S$, by bringing the restorer layer 24 and deflector layer 22 into good thermal contact with a heat sink portion 11 of the device substrate 10. Most simply, if substrate 10 is constructed from a material having good thermal conductivity and heat capacity characteristics, such as silicon, then substrate 10 itself is a heat sink. Alternatively a good heat sink material may be configured in the substrate 10 near to the anchor portion 20*b* of cantilevered element 20.

Figure 15:
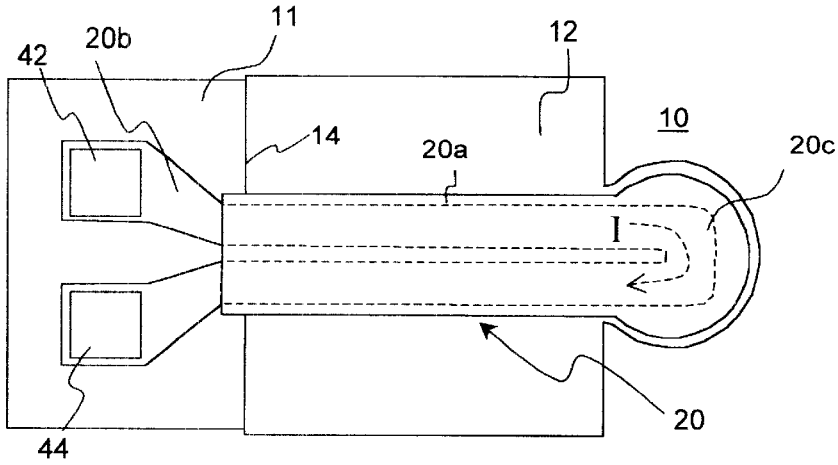
FIG. 15 is a plan view of three configurations of the fixed end termination's of the restorer and deflector layers of a cantilevered element according to the present invention.

FIG. 15 shows a plan view of three alternative configurations of the restorer and deflection layer termination in the anchor portion 20*b* of cantilevered element 20. FIG. 15*a* illustrates a configuration wherein the deflector layer 22 is configured as an electroresistor with lead terminals 42, 44 on substrate 10. Region 11 of substrate 10 designates a good heat sink material, such as silicon. Restorer layer 24 is not brought into good thermal contact with heat sink portion 11 in the configuration of FIG. 15*a*.

Figure 15B:
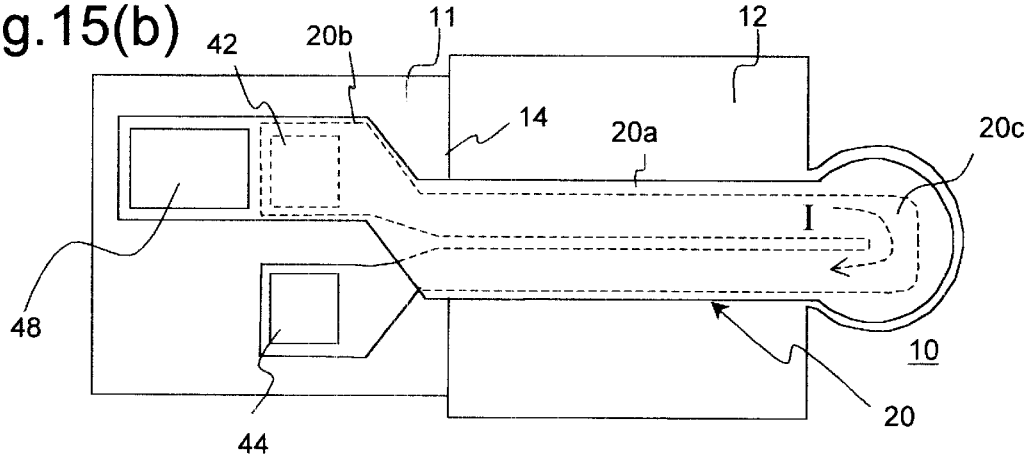

FIG. 15*b* illustrate a configuration similar to that of FIG. 15*a* except that restorer layer 24 has been patterned to extend over lead 42 to pad 48 which makes good thermal contact to the heat sink portion 11 of substrate 10. An electrically insulative layer, preferably an extension of a material layer used to form barrier layer 23, may be required to electrically isolate deflector and restorer layer materials in the areas of crossover above lead 42. It may be acceptable to allow electrical and intimate thermal connection between deflector and restorer materials at one electrical input lead as long as electrical isolation is maintained between the restorer layer 24 and the other input lead.

Figure 15C:
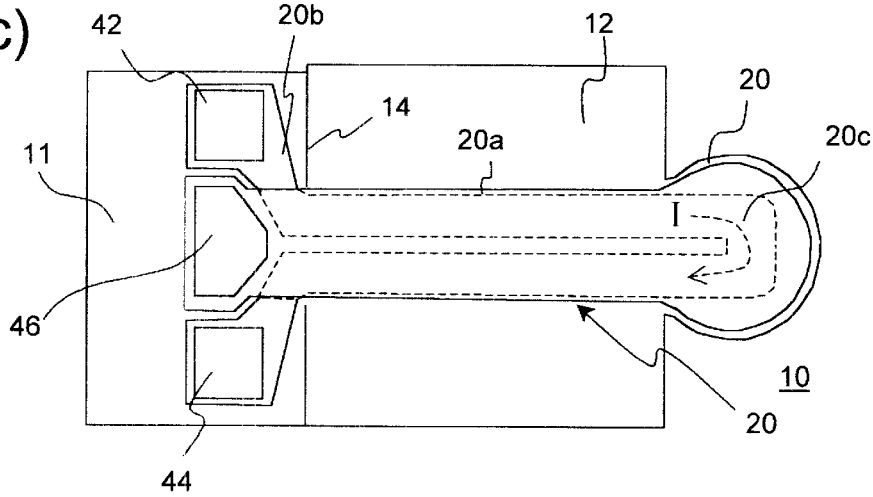

FIG. 15*c* illustrates a configuration similar to that of FIG. 15*a* except that restorer layer 24 has been patterned to extend into good thermal contact with the heat sink portion 11 of substrate 10 at a thermal contact pad 46, positioned in between electrical input pads 42 and 44. The configurations illustrated in FIGS. 15*b* and 15*c* will promote faster heat from the cantilevered element than will the configuration of FIG. 15*a*. The heat transfer time constants $\tau_S$, for the configurations which provide good thermal contact to heat sink portion 11 for both the restorer layer 24 as well as to deflector layer 2, will be significantly reduced.

Figure 16:
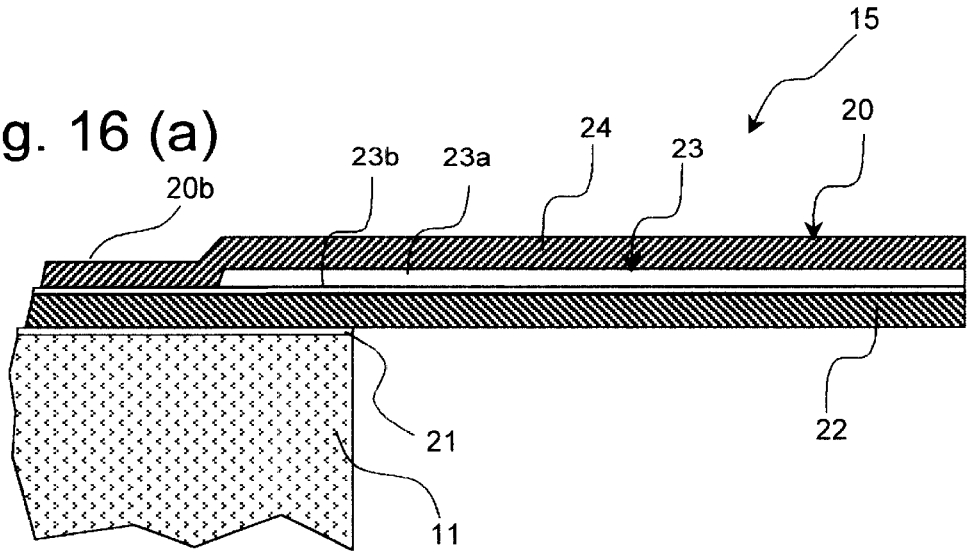
FIG. 16 is a side view of three configurations of the fixed termination's of the restorer and deflector layers of a cantilevered element according to the present invention.
Figure 16:
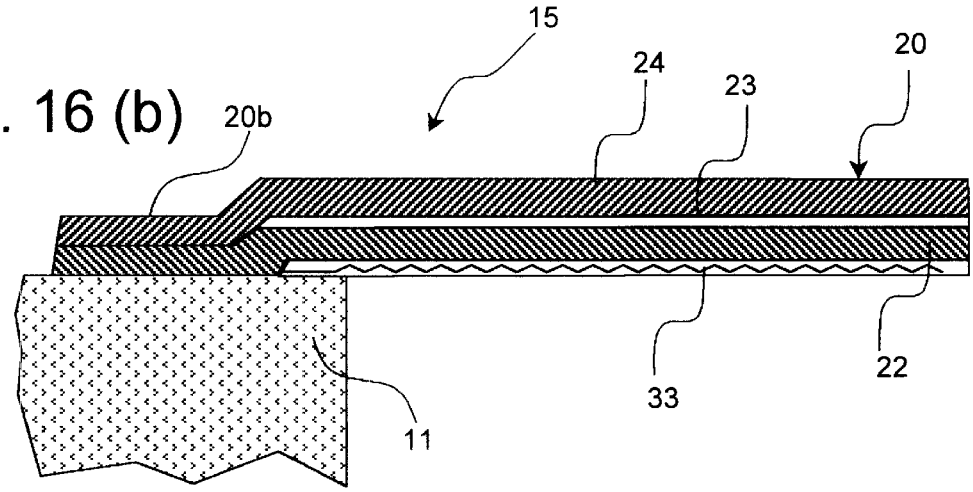
Figure 16:
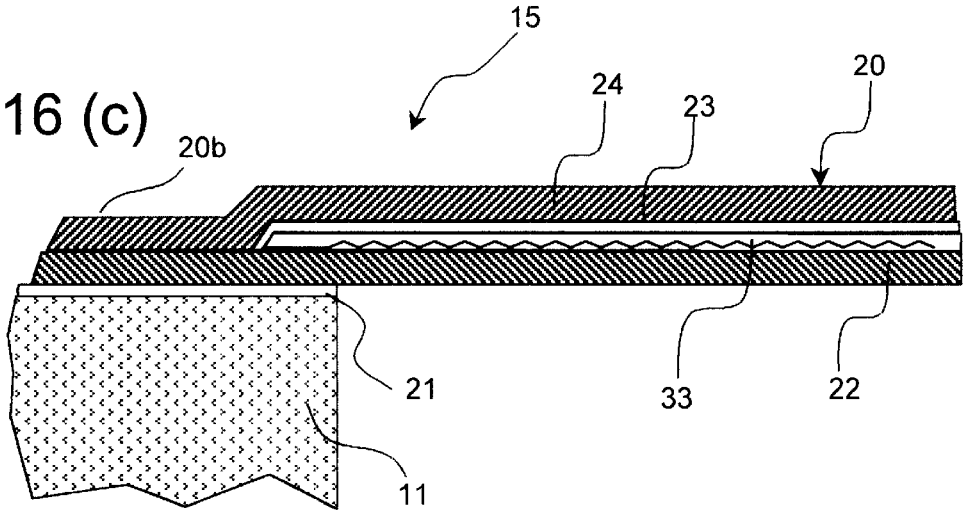

FIG. 16 illustrates three alternative preferred embodiments of the present inventions. FIG. 16 illustrates side views of cantilevered actuators sectioned so as to show alternative configurations which achieve good thermal contact of the restorer and deflector layer materials with a heat sink portion 11 of substrate 10. FIG. 16*a* shows the deflector layer 22 isolate from heat sink portion 11 by a thin electrical isolation layer 21. Restorer layer 24 is brought over deflection layer 22, isolated by thin electrical isolation layer 2 a which also serves as a portion of thermal barrier layer 23. Barrier layer 23 is comprised of sub-layers 23*a* and 23*b*. Sub-layer 23*a* may be made thin, sufficient for electrical isolation if needed while sub-layer 23*b* is formed with a thickness appropriate to achieve a design specification for the heat transfer time constant, $\tau_B$.

FIG. 16*b* illustrates a configuration in which a thin film resistor apparatus 33 is adapted to heat deflector layer 22. Deflect or layer 22 and restorer layer 24 are brought into direct contact with each other and with the heat sink portion 11 of substrate 10. FIG. 16*c* illustrates a configuration in which a thin film resistor apparatus 33 is adapted to heat deflection layer 22 at an interface with barrier layer 23. Deflector layer 22 and restorer layer 24 are brought into contact with each other and with the heat sink portion 11 of substrate 10 through a thin electrical isolation layer 21.

Figure 17:
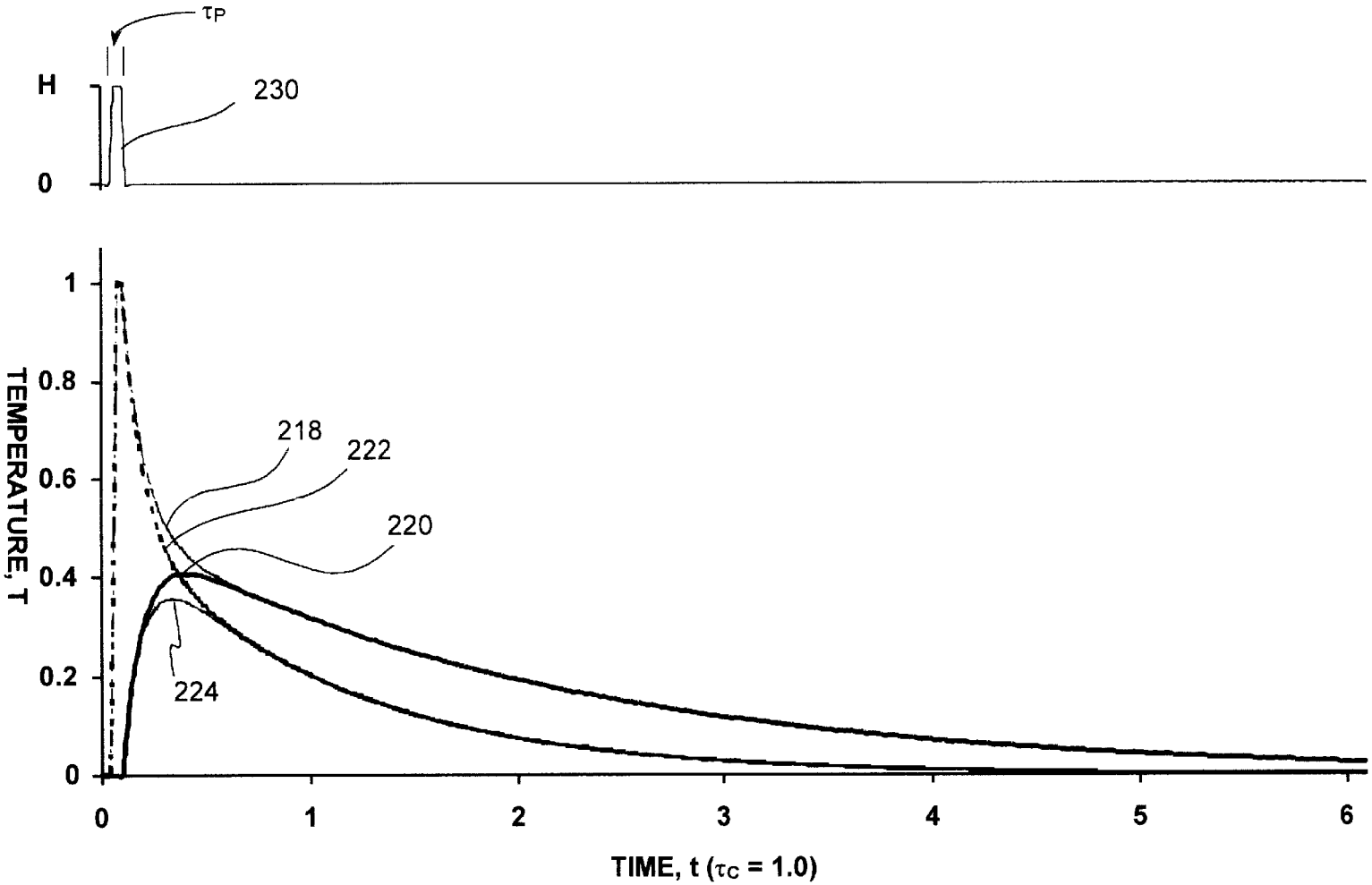
FIG. 17 is a plot of temperature versus time for deflector and restorer layers for two configurations of the fixed end of a cantilevered element according to the present invention

FIG. 17 illustrates the temperature, T, versus time, t, of restorer and deflector layers for two values of the heat transfer to surround time constant, $\tau_S$. For all curves, the barrier layer time constant $\tau_B$=0.1 $\tau_C$. For curves 218 and 220, $\tau_S$=2.0 $\tau_C$. For curves 222 and 224, $\tau_S$=1.0 $\tau_C$. Curves 218 and 222 illustrate deflector layer temperature and curves 220 and 224 illustrate restorer layer temperature. Curves 222 and 224 represent the improved thermal recovery that is realized by bringing both restorer and deflector layers into good thermal contact with a heat sink portion 11 of substrate 10. That is, significant reduction of the heat transfer time constant to the surround, approaching a factor of 2, may be realized, especially when an electrically resistive, high thermal conductivity material, such as titanium aluminide, is used for constructing deflector and restorer layers. Also illustrated in FIG. 17 is a heating pulse 230 having a pulse duration time of $\tau_P$. Heating pulse 230 is applied to deflector layer 2.

In operating the thermal actuators according to the present inventions, it is advantageous to select the electrical pulsing Parameters with recognition of the heat transfer time constant, $\tau_B$, of the barrier layer 23. Once designed and fabricated, a thermal actuator having a cantilevered design according to the present inventions, will exhibit a characteristic time constant, $\tau_B$, for heat transfer between deflector layer 22 and restorer layer 24 through barrier layer 23. For efficient energy use and maximum deflection performance, heat pulse energy is applied over a time which is short compared to the internal energy transfer process characterized by $\tau_B$. Therefore it is preferable that applied heat energy or electrical pulses for electrically resistive heating have a duration of $\tau_P$, where $\tau_P<\tau_B$ and, preferably, $\tau_P<\frac{1}{2}\tau_B$. In addition, it is desirable for the reasons that cantilevered element 20 have restored to its first or nominal position before a next actuation pulse is applied. Consequently it is preferred that the activation repetition period $\tau_C$ be much longer than $\tau_B$. Most preferably, it is best that $\tau_C>3\ \tau_B$ for efficient and reproducible activation of the thermal actuators and liquid drop emitters of the present invention.

While much of the foregoing description was directed to the configuration and operation of a single drop emitter, it should be understood that the present invention is applicable to forming arrays and assemblies of multiple drop emitter units. Also it should be understood that thermal actuator devices according to the present invention may be fabricated concurrently with other electronic components and circuits, or formed on the same substrate before or after the fabrication of electronic components and circuits.

Further, while the foregoing detailed description primarily discussed thermal actuators heated by electrically resistive apparatus, other means of generating heat pulses, such as inductive heating or pulsed light, may be adapted to apply heat pulses to deflector layers according to the present invention.

From the foregoing, it will be seen that this invention is one well a adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 substrate base element
11 heat sink portion of substrate 10
12 liquid chamber
13 gap between cantilevered element and chamber wall
14 wall edge at cantilevered element anchor
15 thermal actuator
16 liquid chamber curved wall portion
20 cantilevered element
20*a* cantilevered element bending portion
20*b* cantilevered element anchor portion
20*c* cantilevered element free end portion
21 passivation layer,
22 deflector layer
23 barrier layer
23*a* barrier layer sub-layer
23*b* barrier layer sub-layer
24 restorer layer
25 passivation layer
27 resistor portion of deflector layer
28 liquid chamber structure, walls and cover
29 sacrificial layer
30 nozzle
33 thin film resistor heater structure
41 TAB lead
42 electrical input pad
43 solder bump
44 electrical input pad
46 thermal contact pad
48 thermal contact pad
50 drop
60 fluid
80 mounting structure
100 ink jet printhead
110 drop emitter unit
200 electrical pulse source
300 controller
400 image data source
500 receiver

What is claimed is:

1. A thermal actuator for a micro-electromechanical device comprising:

(a) a base element;

(b) a cantilevered element extending from the base element and residing at a first position, the cantilevered element including a barrier layer constructed of a low thermal conductivity material, bonded between a deflector layer and a restorer layer; and (c) apparatus adapted to apply a heat pulse directly to the deflector layer, causing a thermal expansion of the deflector layer relative to the restorer layer and deflection of the cantilevered element to a second position, followed by restoration of the cantilevered element to the first position as heat diffuses through the barrier layer to the restorer layer and the cantilevered element reaches a uniform temperature.

2. The thermal actuator of claim 1 wherein the deflector layer and the restorer layer are constructed of the same material.

3. The thermal actuator of claim 2 wherein the deflector layer and the restorer layer are substantially equal in thickness.

4. The thermal actuator of claim 1 wherein the deflector layer and the restorer layer are constructed of materials having substantially equal coefficients of thermal expansion and Young's modulus and ire substantially equal in thickness.

5. The thermal actuator of claim 1 wherein the barrier layer is a laminate structure comprised of more than one low thermal conductivity material.

6. The thermal actuator of claim 1 wherein the apparatus adapted to apply a heat pulse comprises a thin film resistor.

7. The thermal actuator of claim 6 wherein the thin film resistor is located adjacent an interface between the barrier layer and the deflector layer.

8. The thermal actuator of claim 1 wherein the heat pulse has a time duration of $\tau_P$, the barrier layer has a heat transfer time constant of $\tau_B$, and $\tau_B>2\ \tau_P$.

9. The thermal actuator of claim 1 wherein the base element further includes a heat sink portion and the deflector layer and the restorer layer are brought into good thermal contact with the heat sink portion.

10. A thermal actuator for a micro-electromechanical device comprising:

(a) a base element;

(b) a cantilevered element extending from the base element and residing at a first position, the cantilevered element including a barrier layer constructed of a dielectric material having low thermal conductivity, a deflector layer constructed of an electrically resistive material having large coefficient of thermal expansion, and a restorer layer, wherein the barrier layer is bonded between the deflector layer and the restorer layer; and (c) a pair of electrodes connected to the deflector layer to apply an electrical pulse to cause resistive heating of the deflector layer, resulting in a thermal expansion of the deflector layer relative to the restorer layer and deflection of the cantilevered element to a second position, followed by restoration of the cantilevered element to the first position as heat diffuses through the barrier layer to the restorer layer and the cantilevered element reaches a uniform temperature.

11. The thermal actuator of claim 10 wherein the restorer layer is constructed of the electrically resistive material.

12. The thermal actuator of claim 11 wherein the deflector layer and the restorer layer are substantially equal in thickness.

13. The thermal actuator of claim 10 wherein the deflector layer and the restorer layer are constructed of materials having substantially equal coefficients of thermal expansion and Young's modulus an are substantially equal in thickness.

14. The thermal actuator of claim 10 wherein the electrically resistive material is titanium aluminide.

15. The thermal actuator of claim 10 wherein the barrier layer is a laminate structure comprised of more than one low the conductivity material.

16. The thermal actuator of claim 10 wherein the electrical pulse has a time duration of $\tau_P$, the barrier layer has a heat transfer time constant of $\tau_B$, and $\tau_B>2\ \tau_P$.

17. The thermal actuator of claim 10 wherein the base element further includes a heat sink portion and the deflector layer an the restorer layer are brought into good thermal contact with the heat sink portion.

18. A method for operating a thermal, said thermal actuator comprising a base element, a cantilevered element extending from the base element and residing in a first position, the cantilevered element including a barrier layer, having a heat transfer time constant of $\tau_B$, bonded between a deflector layer and a restorer layer which are both constructed of the same electrically resistive material; and a pair of electrodes connected to the deflector layer to apply an electrical pulse to heat the deflector layer, the method for operating comprising:

(a) applying to the pair of electrodes an electrical pulse having duration $\tau_P$, and which provides sufficient heat energy to cause thermal expansion of the deflector layer relative to the restorer layer, resulting in deflection of the cantilevered element to a second position, where $\tau_P<\frac{1}{2}\tau_B$ and (b) waiting for a time $\tau_C$ before applying a next electrical pulse, where $\tau_C>3\ \tau_B$, so that heat diffuses through the barrier layer to the restorer layer and the cantilevered element is restored substantially to the first position before next deflecting the cantilevered element.

19. A liquid drop emitter comprising:

(a) a chamber, formed in a substrate, filled with a liquid and having a nozzle for emitting drops of the liquid;

(b) a thermal actuator having a cantilevered element extending from a wall of the chamber and a free end residing in a first position proximate to the nozzle, the cantilevered element including a barrier layer constructed of a low thermal conductivity material, bonded between a deflector layer and a restorer layer; and (c) apparatus adapted to apply a heat pulse directly to the deflector layer, causing a thermal expansion of the deflector layer relative to the restorer layer and rapid deflection of the cantilevered element, ejecting liquid at the nozzle, followed by restoration of the cantilevered element to the first position as heat diffuses through the barrier layer to the restorer layer and the cantilevered element reaches a uniform temperature.

20. The liquid drop emitter of claim 19 wherein the deflector layer and the restorer layer are constructed of the same material.

21. The liquid drop emitter of claim 20 wherein the deflector layer and the restorer layer are substantially equal in thickness.

22. The liquid drop emitter of claim 19 wherein the deflector layer and the restorer layer are constructed of materials having substantially equal coefficients of thermal expansion and Young's modulus and are substantially equal in thickness.

23. The liquid drop emitter of claim 19 herein the barrier layer is a laminate structure comprised of more than one low the conductivity material.

24. The liquid drop emitter of claim 19 wherein the apparatus adapted to apply a heat pulse comprises a thin film resistor.

25. The liquid drop emitter of claim 24 wherein the thin film resistor is located adjacent an interface between the barrier layer and the deflector layer.

26. The liquid drop emitter of claim 19 wherein the heat pulse has a time duration of $\tau_P$, the barrier layer has a heat transfer time constant of $\tau_B$, and $\tau_B>2\ \tau_P$.

27. The liquid drop emitter of claim 19 wherein the substrate further includes a heat sink portion and the deflector layer and the restorer layer are brought into good thermal contact with the heat sink portion.

28. The liquid drop emitter of claim 19 wherein the liquid drop emitter is a drop-on-demand ink jet printhead and the liquid is an ink for printing image data.

29. A liquid drop emitter comprising:

(a) a chamber, formed in a substrate, filled with a liquid and having a nozzle for emitting drops of the liquid;

(b) a thermal actuator having a cantilevered element extending from a wall of the chamber and a free end residing in a first position proximate to the nozzle, the cantilevered element including a barrier layer constructed of a dielectric material having low thermal conductivity, a deflector layer constructed of an electrically resistive material having a large coefficient of thermal expansion, and a restorer layer, wherein the barrier layer is bonded between the deflector layer and the restorer layer; and (c) a pair of electrodes connected to the deflector layer to apply an electrical pulse to cause resistive heating of the deflector layer, resulting in a thermal expansion of the deflector layer relative to the restore layer and rapid deflection of the cantilevered element, ejecting liquid at the nozzle, followed by restoration of the cantilevered element to the first position as heat diffuses through the barrier layer to the restorer layer and the cantilevered element reaches a uniform temperature.

30. The liquid drop emitter of claim 29 wherein the restorer layer is constructed of the electrically resistive material.

31. The liquid drop emitter of claim 30 wherein the deflector layer and the restorer layer are substantially equal in thickness.

32. The liquid drop emitter of claim 29 wherein the deflector layer and the restorer layer are constructed of materials having substantially equal coefficients of thermal expansion and Young's modulus and are substantially equal in thickness.

33. The liquid drop emitter of claim 29 wherein the electrically resistive material is titanium aluminide.

34. The liquid drop emitter of claim 29 wherein the barrier layer is a laminate structure comprised of more than one low thermal conductivity material.

35. The liquid drop emitter of claim 29 wherein the electrical pulse has a time duration of $\tau_P$ and the barrier layer has a heat transfer time constant of $\tau_B$, and $\tau_B > 2\ \tau_P$.

36. The liquid drop emitter of claim 29 wherein the substrate further includes a heat sink portion and the deflector layer and the restorer layer are brought into good thermal contact with the heat sink portion.

37. The liquid drop emitter of claim 29 wherein the liquid drop emitter is a drop-on-demand ink jet printhead and the liquid is an ink for printing image data.

38. A method for operating a liquid drop emitter, said liquid drop emitter comprising a chamber, filled with a liquid, having a nozzle for emitting drops of the liquid, a thermal actuator having a cantilevered element extending from a wall of the chamber and a free end residing in a first position proximate to the nozzle for exerting pressure on the liquid at the nozzle, the cantilevered element including a barrier layer, having a heat transfer time constant of $\tau_B$, bonded between a deflector layer and a restorer layer which are both constructed of the same electrically resistive material; and a pair of electrodes connected to the deflector layer to apply an electrical pulse to heat the deflector layer, the method for operating comprising:

(a) applying to the pair of electrodes an electrical pulse of duration $\tau_P$, and which provides sufficient heat energy to cause the expansion of the deflector layer relative to the restorer layer resulting in liquid drop emission, where $\tau_P < \frac{1}{2}\tau_B$; and (b) waiting for a time $\tau_C$ before applying a next electrical pulse, where $\tau_C > 3\ \tau_B$, so that heat diffuses through the barrier layer to the restorer layer and the free end is restored substantially to the first position before next emitting liquid drops.

* * * * *

UNITED STATES PATENT AND TRADEMARK OFFICE

CERTIFICATE OF CORRECTION

PATENT NO. : 6,588,884 B1
DATED : July 8, 2003
INVENTOR(S) : Edward P. Furlani et al.

It is certified that error appears in the above-identified patent and that said Letters Patent is hereby corrected as shown below:

Column 16,
Line 42, change “ire” to -- are --

Column 17,
Line 20, change “an” to -- and --

Column 18,
Line 16, change “herein” to -- wherein --
Line 51, change “restore” to -- restorer --

Column 20,
Line 11, change “the” to -- thermal --

Signed and Sealed this

Eighteenth Day of January, 2005

JON W. DUDAS
*Director of the United States Patent and Trademark Office*